United States Patent [19]

Crossley et al.

[11] 3,978,640

[45] Sept. 7, 1976

[54] HARD-GELATIN CAPSULE FILLING MACHINES

[75] Inventors: Jack Crossley; David Henry Wilson, both of Liverpool, England

[73] Assignee: Manesty Machines, Ltd., Liverpool, England

[22] Filed: Sept. 10, 1974

[21] Appl. No.: 504,766

[30] Foreign Application Priority Data

Sept. 11, 1973 United Kingdom ..... 42616/73

[52] U.S. Cl. ..... 53/37; 53/124 B; 53/282; 53/381 A

[51] Int. Cl.[2] ..... B65B 1/04; B65B 1/24; B65B 43/50

[58] Field of Search ..... 53/24, 37, 281, 282, 53/381 A, 124 B

[56] References Cited

UNITED STATES PATENTS

| | | | |
|---|---|---|---|
| 2,630,953 | 3/1953 | Kath | 53/281 |
| 2,890,557 | 6/1959 | Greer et al. | 53/281 |
| 3,078,629 | 2/1963 | Besener et al. | 53/282 X |
| 3,501,894 | 3/1970 | Hayashi et al. | 53/281 |
| 3,538,677 | 11/1970 | Amoroso et al. | 53/282 X |
| 3,601,954 | 8/1971 | Aronson | 53/282 |

FOREIGN PATENTS OR APPLICATIONS

| | | | |
|---|---|---|---|
| 1,531,968 | 1/1970 | Germany | 53/381 A |

*Primary Examiner*—Leon Gilden
*Attorney, Agent, or Firm*—Flynn & Frishauf

[57] ABSTRACT

A hard-gelatin capsule filling machine for filling two piece capsules is described wherein empty capsules from a random bulk supply thereof, in a hopper, are fed in succession from a feeding station to an uncapping station and then to a filling station and then to a re-capping station and then to an ejection station in a single continuously rotating phase of the machine. The fill for each capsule body is compressed into a soft slug in a die for subsequent insertion into the capsule body during its passage through the filling station.

64 Claims, 30 Drawing Figures

HARD-GELATIN CAPSULE FILLING MACHINES

Figure 1:
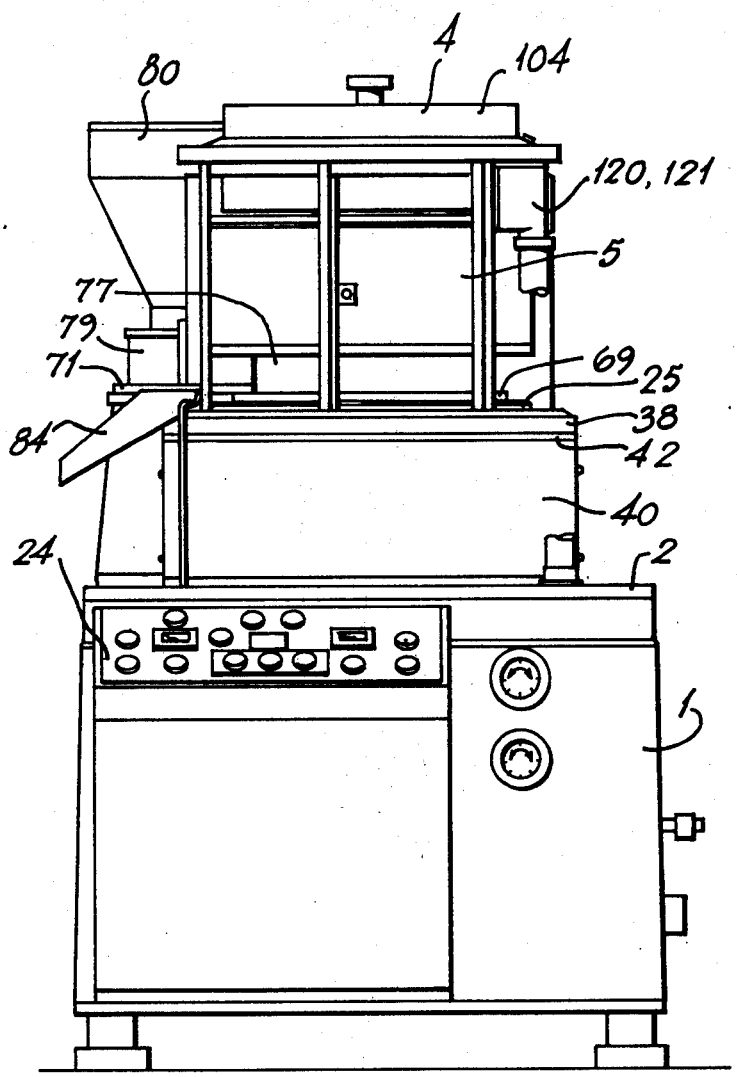

This invention relates to hard-galatin-capsule filling machines and is concerned with hard-galatin-capsule filling machines and of the kind (hereinafter referred to as "the kind described") in which the fill is compressed into a soft slug which is thereafter inserted into the bottom part or body of the capsule.

An object of this invention is to provide an improved, fully automatic, continuous motion machine of the kind described capable of achieving a high output of filled capsules in a given time.

A further object of this invention is to provide such a machine in which each capsule, extracted from a random bulk supply of the capsules in a hopper of the machine, is uncapped, filled, and then re-capped with the original cap.

A still further object of this invention is to maintain original orientation between the filled body of the capsule and the cap, when the capsule is re-capped.

A still further object of this invention is to provide such a machine in which the dose of fill compressed into each slug is accurately measured, and is accurately reproduced from slug to slug.

A still further object of this invention is to provide such a machine in which the fill dose is readily adjustable by means of a single control regardless or not of whether the machine is running.

A still further object of this invention is to provide such a machine in which the degree of compression of each slug is readily adjustable by means of a single control regardless or not of whether the machine is running.

A still further object of this invention is to provide such a machine which is readily changed over to fill capsules of different sizes.

Broadly, this invention provides a hard-gelatin-capsule filling machine for filling two piece capsules and of the kind described in which the capsules are uncapped, filled, re-capped and thereafter ejected in a single, continuously rotating phase of the machine.

More specifically, according to a feature of this invention, a series of the capsules are fed successively from a bulk supply of the capsules, uncapped, filled, re-capped and thereafter ejected, these steps taking place at successive stations in the single rotating phase.

According to a further feature of this invention the empty capsules are fed downwardly, singly in succession, to the uncapping station in the single rotating phase, each through one of a succession of capsule delivery tubes disposed in circular array in said single rotating phase of the machine.

According to a further feature of this invention the empty capsules are fed from a random bulk supply of the capsules in a hopper disposed above said circular array of capsule delivery tubes, capsules being fed, in succession from the hopper to the delivery tubes at a feeding station in advance of the uncapping station.

According to a further feature of this invention the filling station is disposed at a lesser radius than the feeding, uncapping and re-capping stations in said single rotating phase of the machine, and each capsule body is moved radially inwardly to pass through the filling station, after it has been uncapped, and thereafter radially outwardly to pass through the re-capping station.

According to a further feature of this invention each slug of fill is formed in a die between upper and lower punches and is delivered into a capsule body through the lower end of the die by the upper punch.

Still further important features of this invention include the means for feeding the empty capsules from the random bulk supply of capsules in the hopper into the capsule delivery tubes, singly, and in correct orientation with the cap uppermost.

Figure 2:
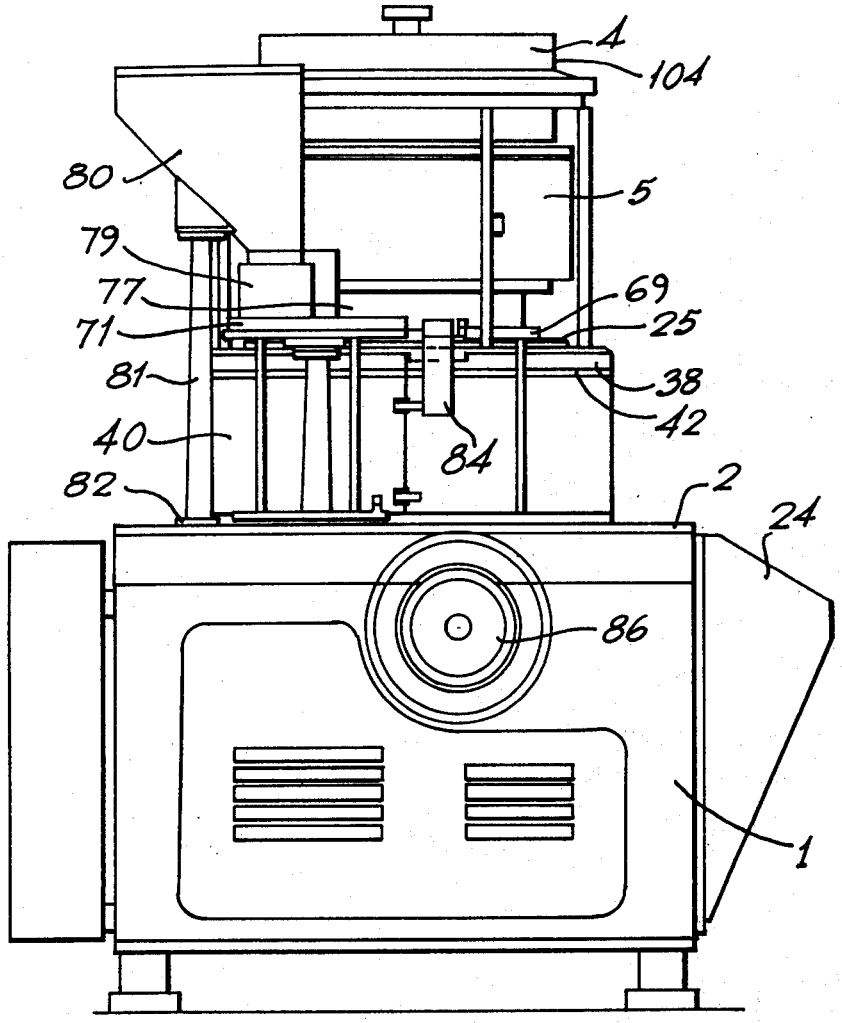
Figure 3:
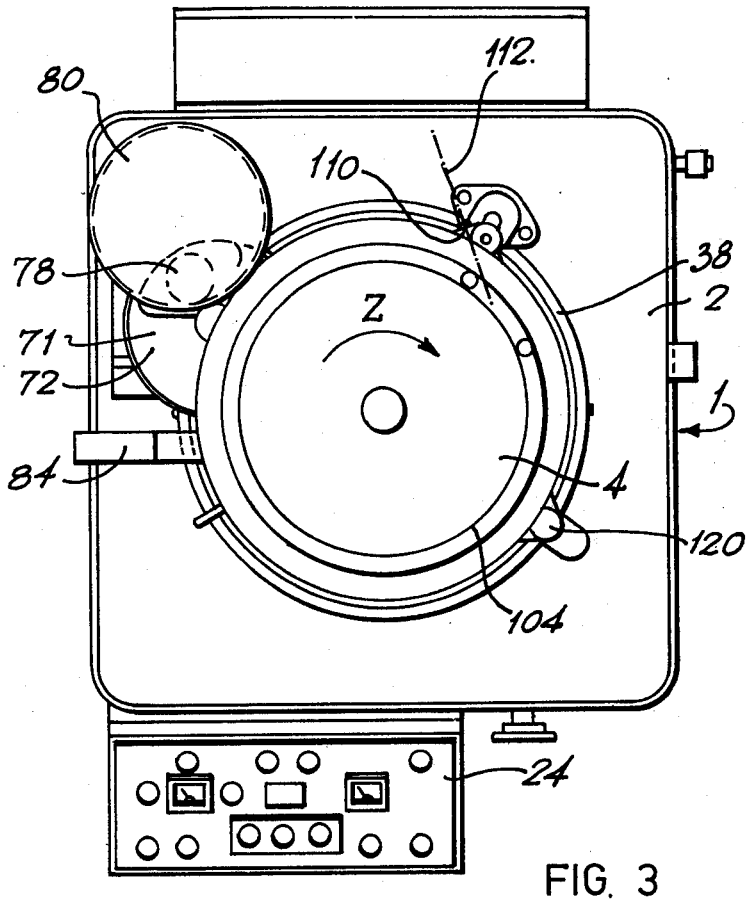
Figure 4:
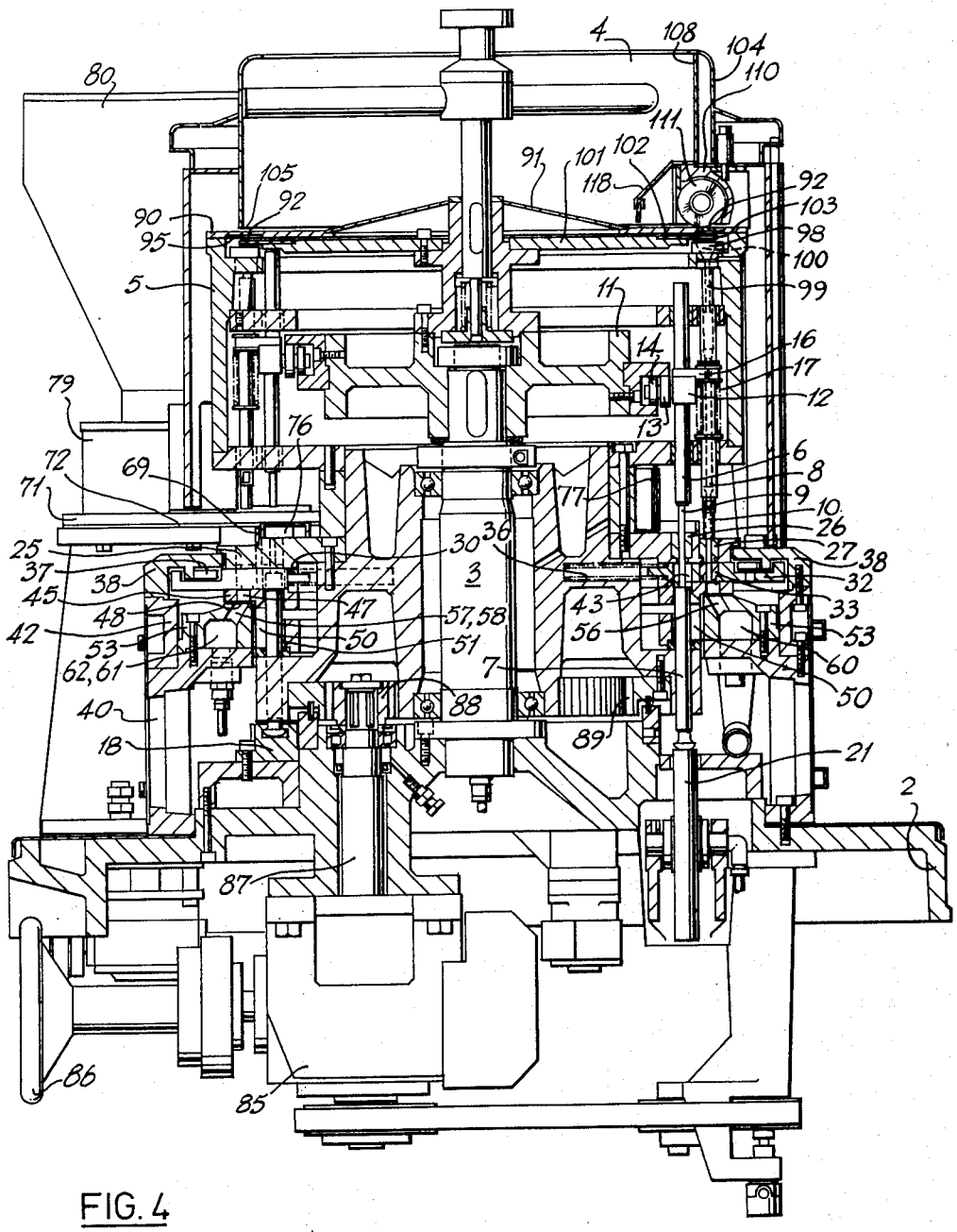
Figure 5:
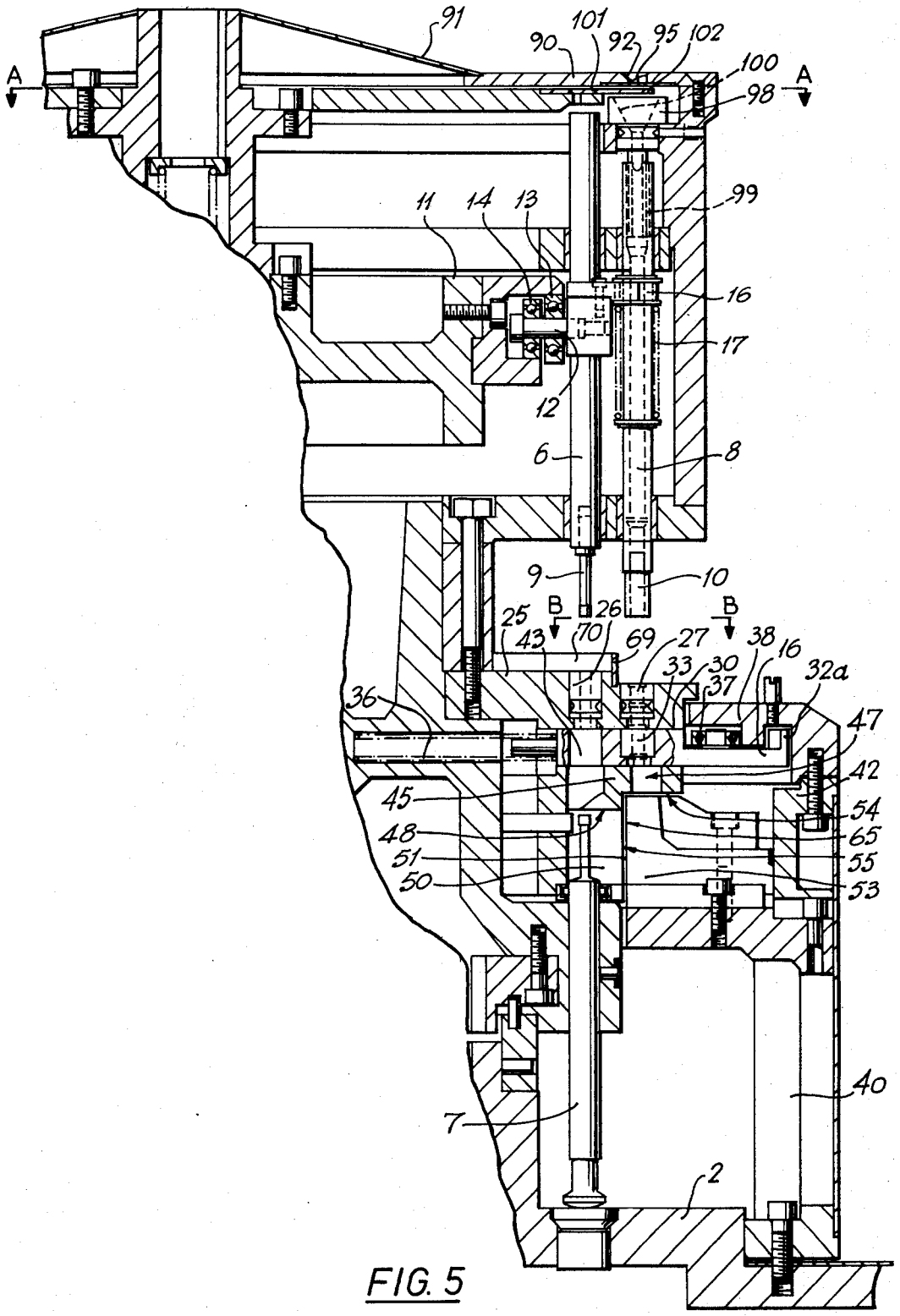
Figure 6:
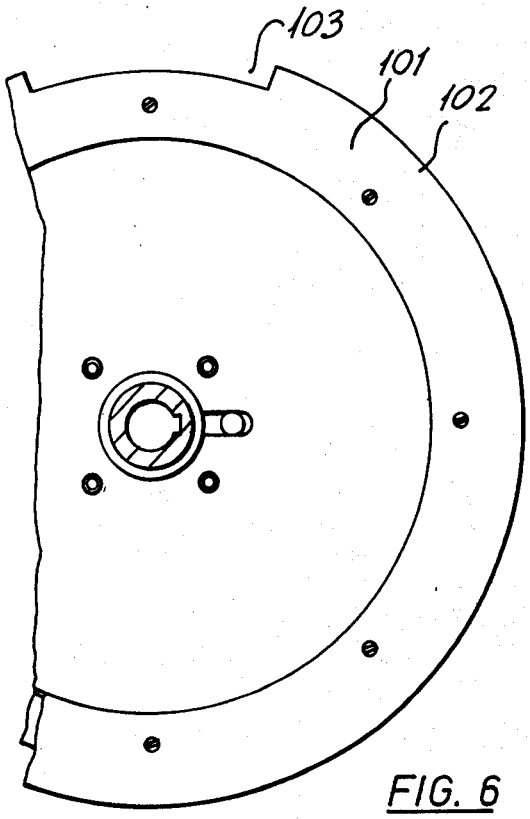
Figure 7:
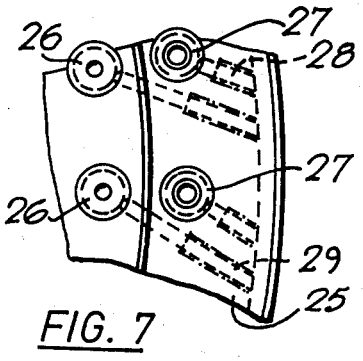
Figure 8:
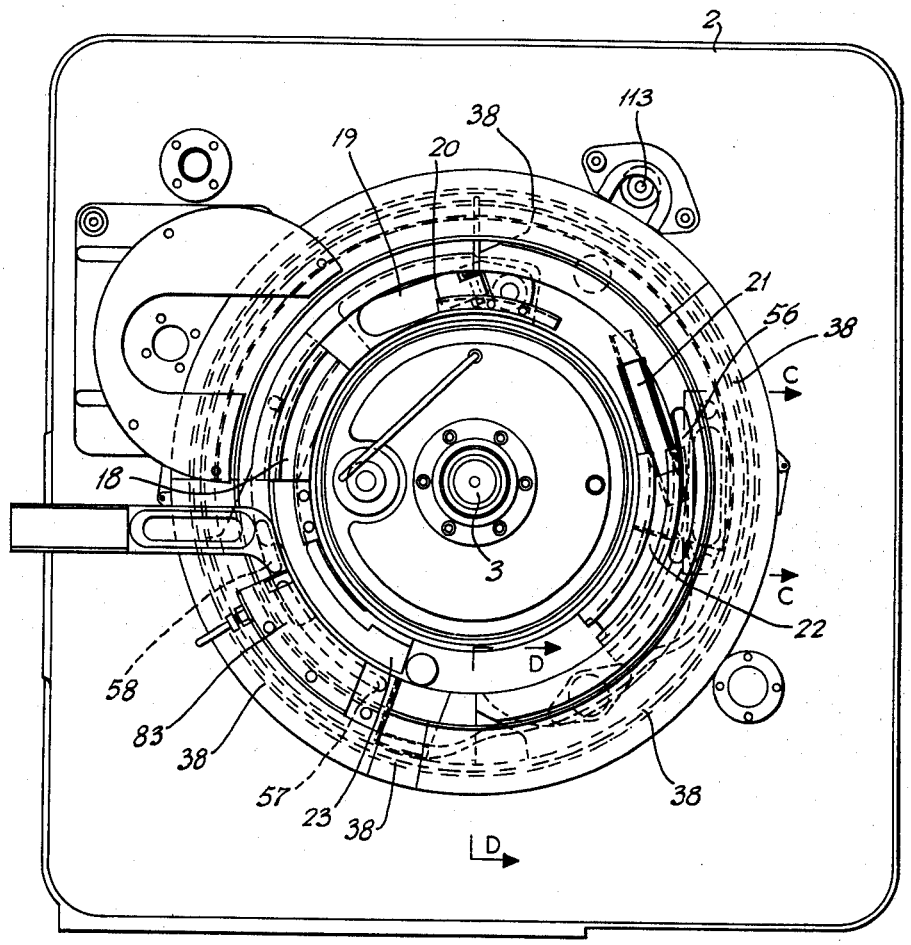
Figure 9:
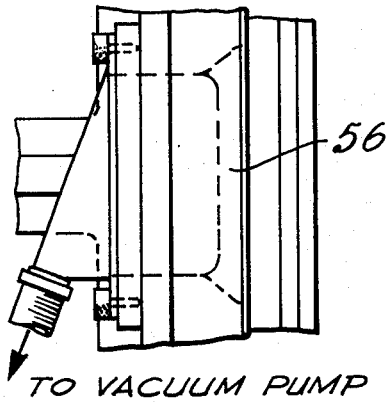
Figure 10:
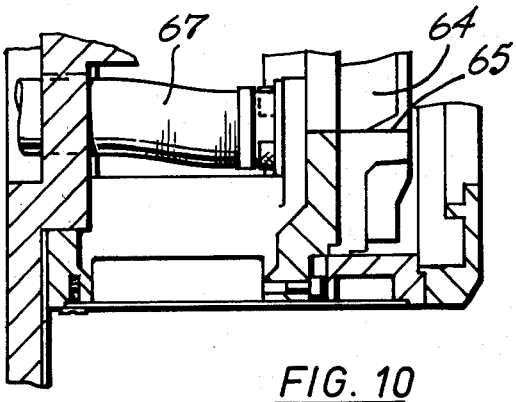
Figure 11:
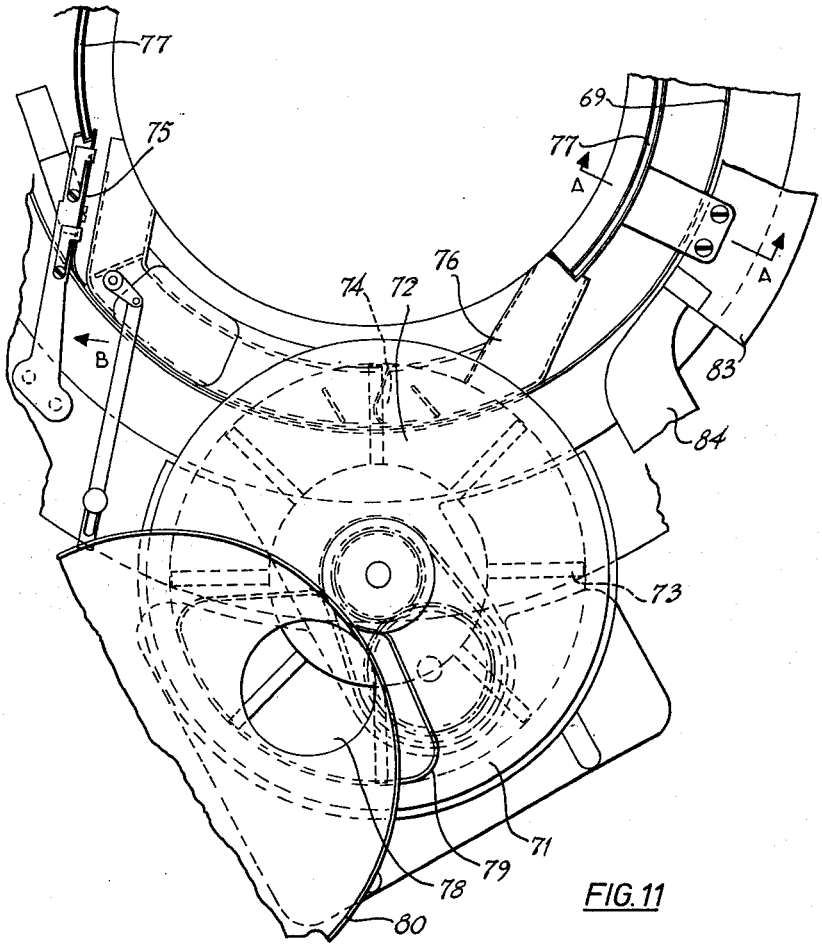
Figure 13:
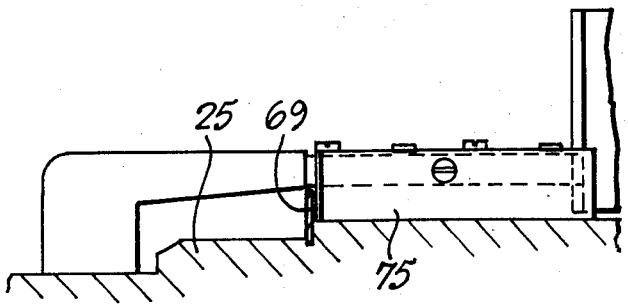
Figure 12:
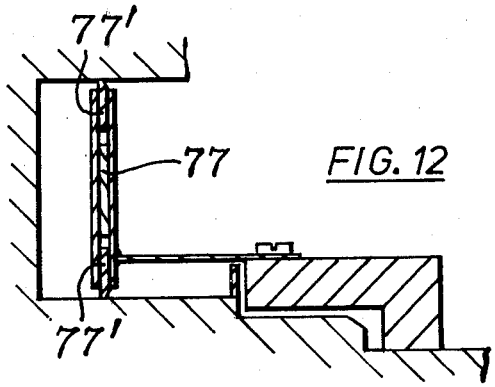
Figure 14:
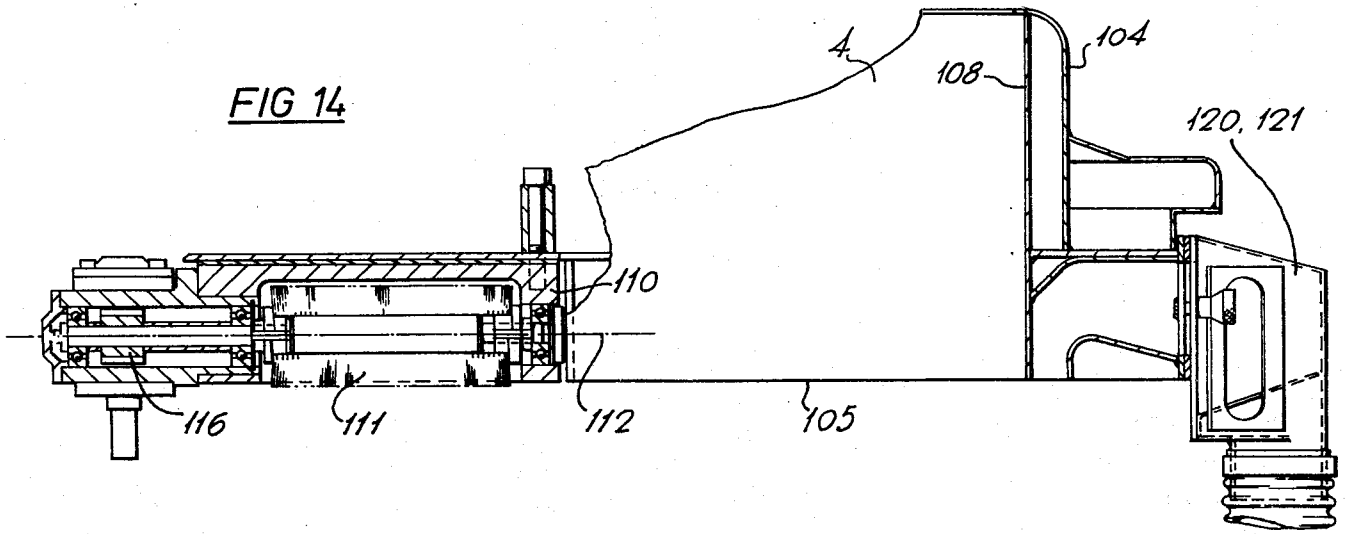
Figure 15:
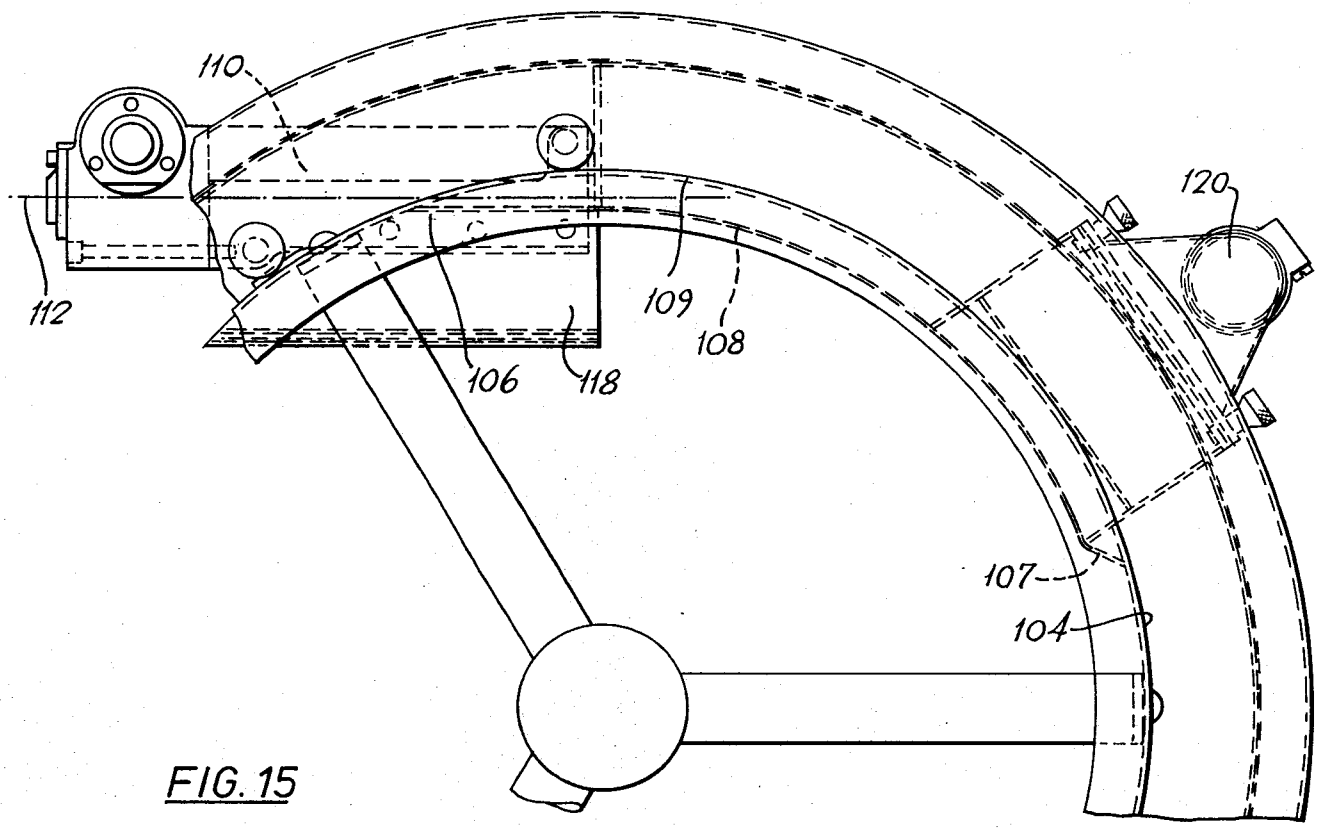
Figure 16:
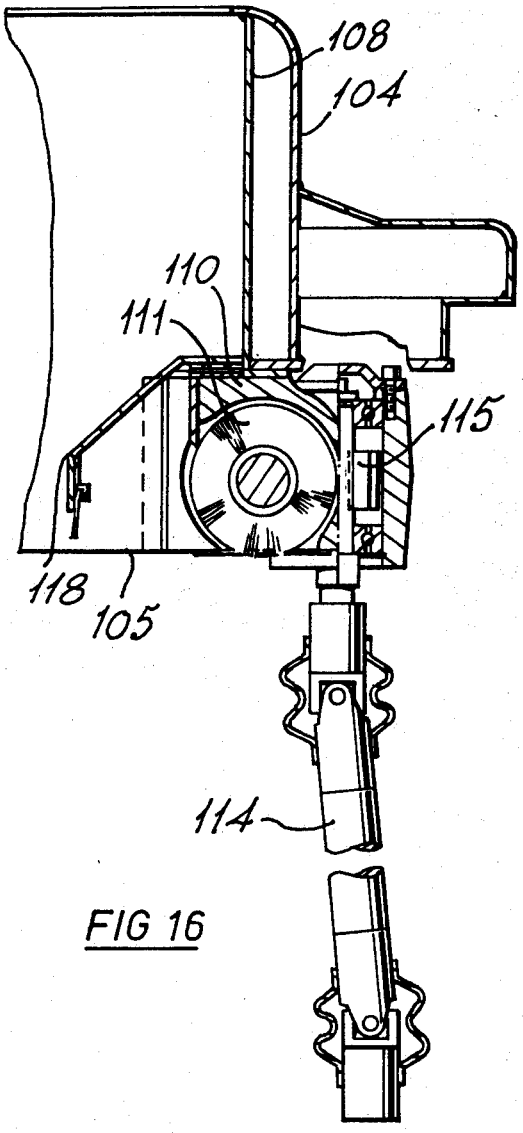
Figure 17:
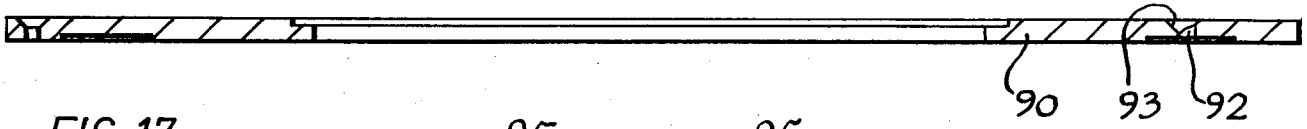
Figure 18:
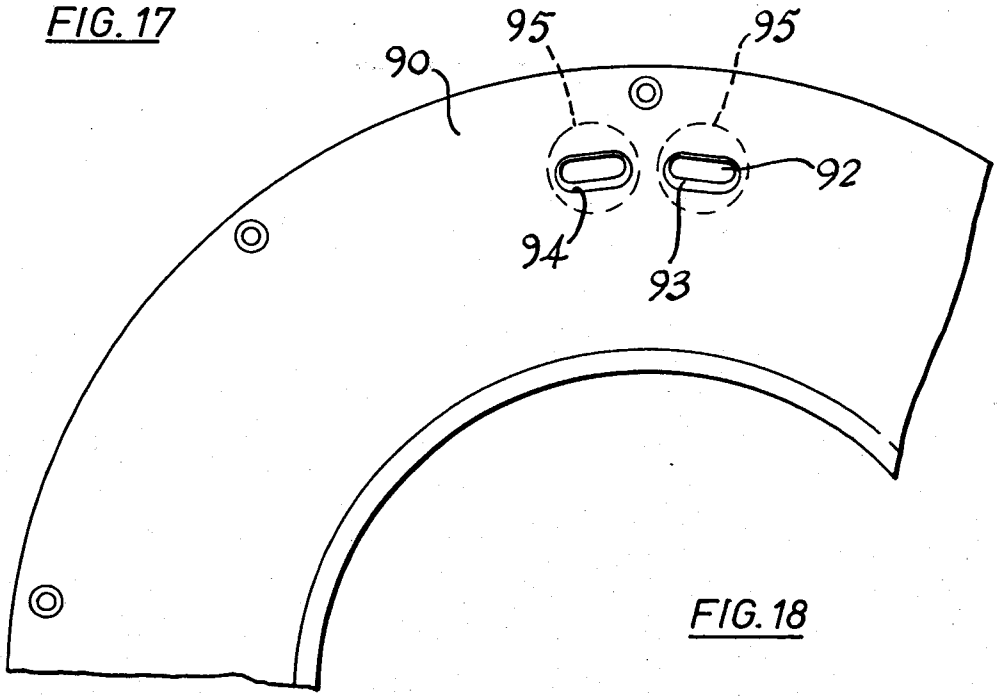
Figure 19:
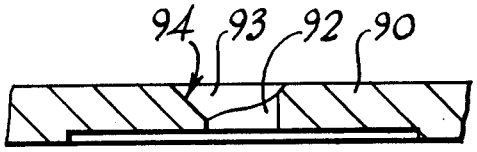
Figure 20:
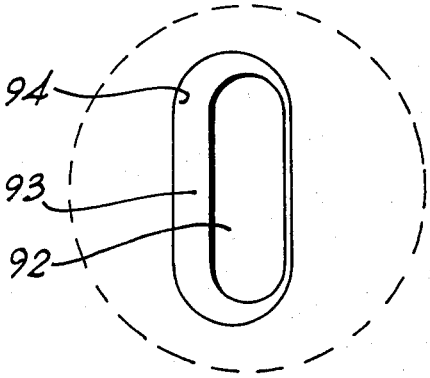
Figure 23:
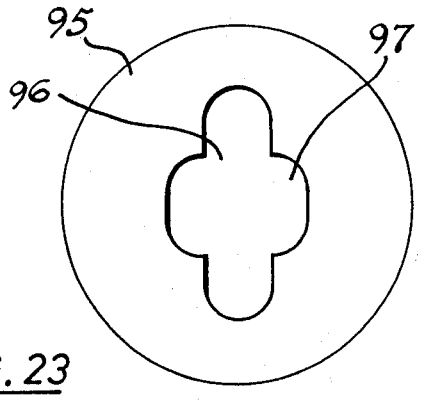
Figure 21:
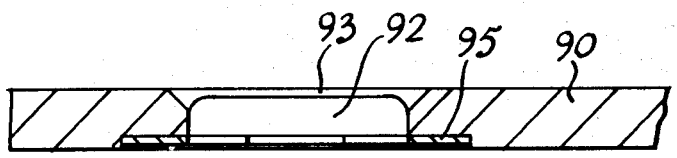
Figure 22:
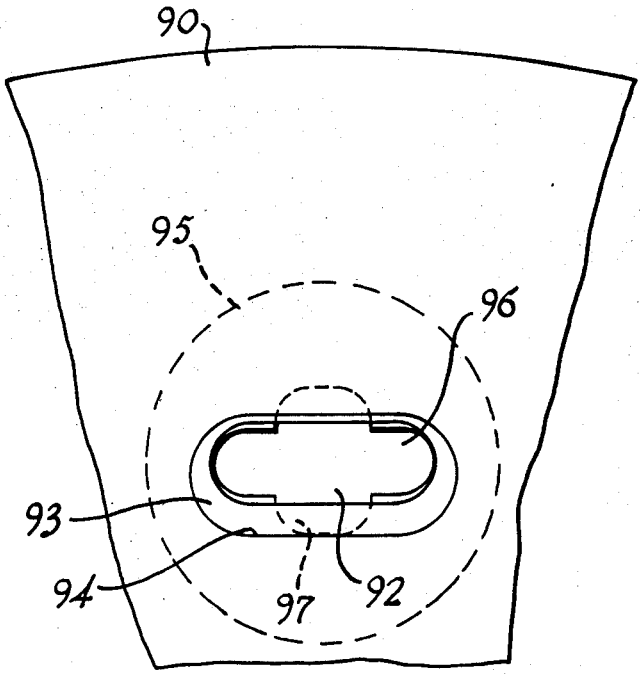
Figure 24:
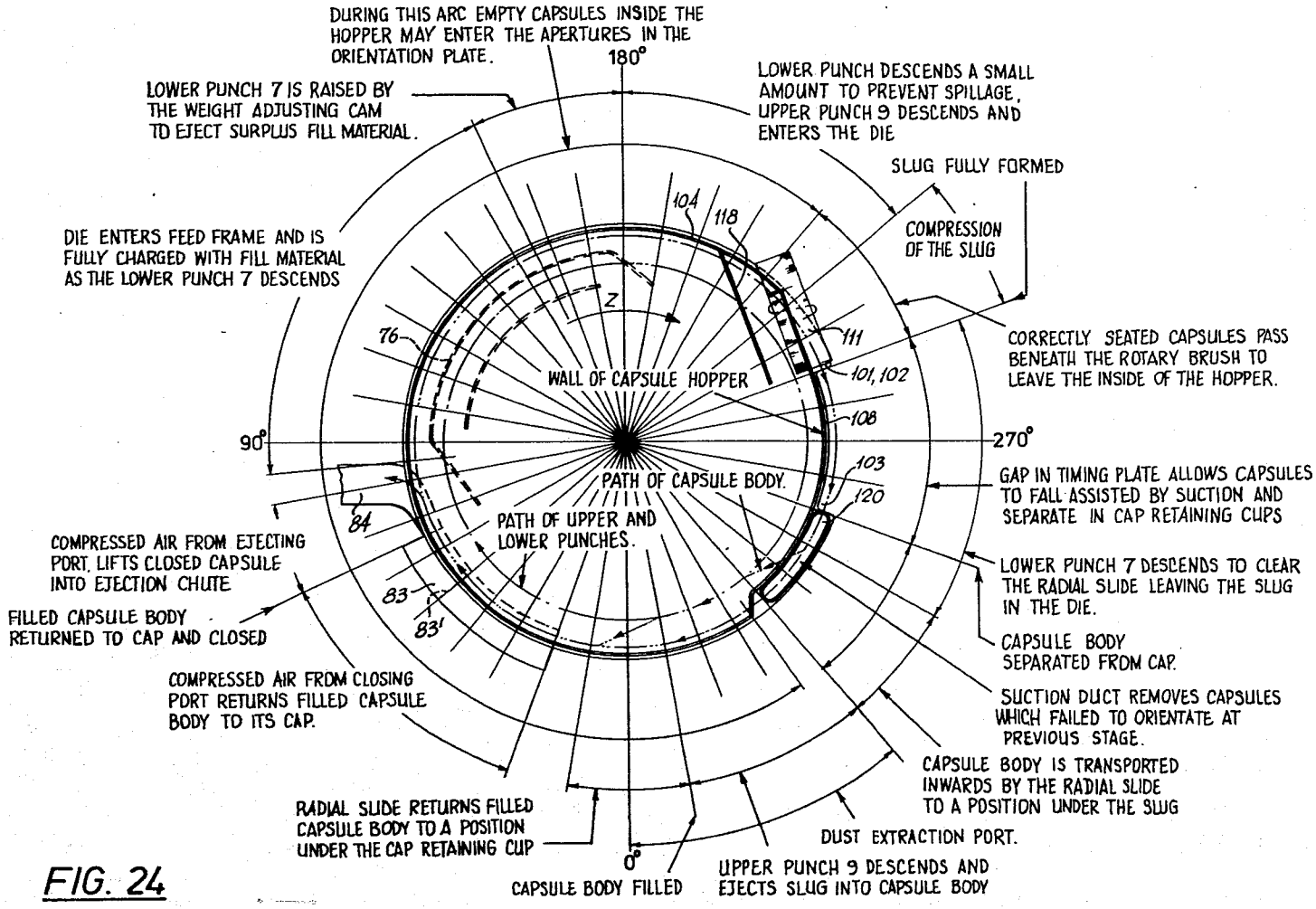
Figure 25:
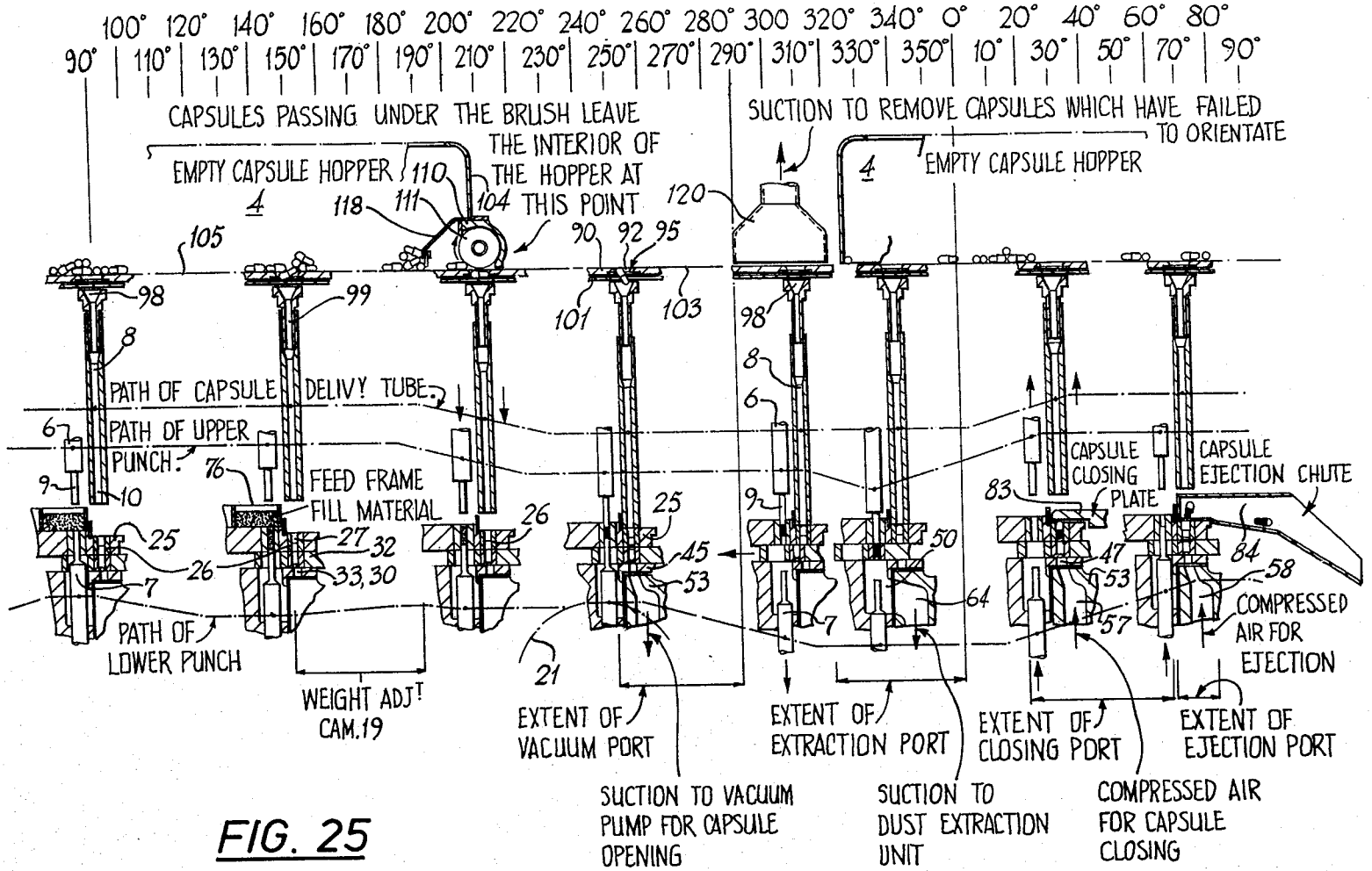
Figure 26:
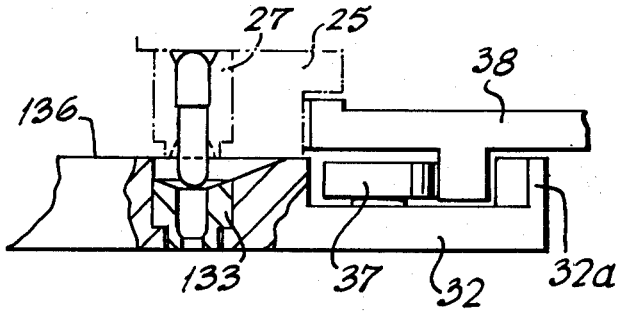
Figure 27:
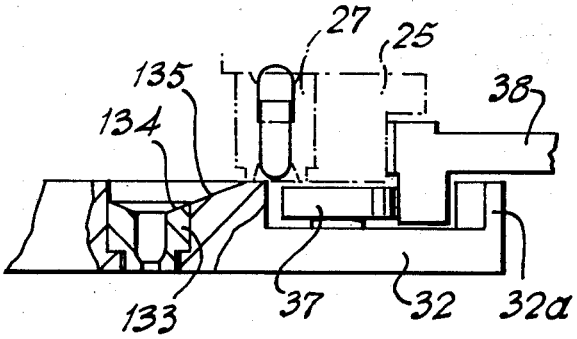
Figure 28:
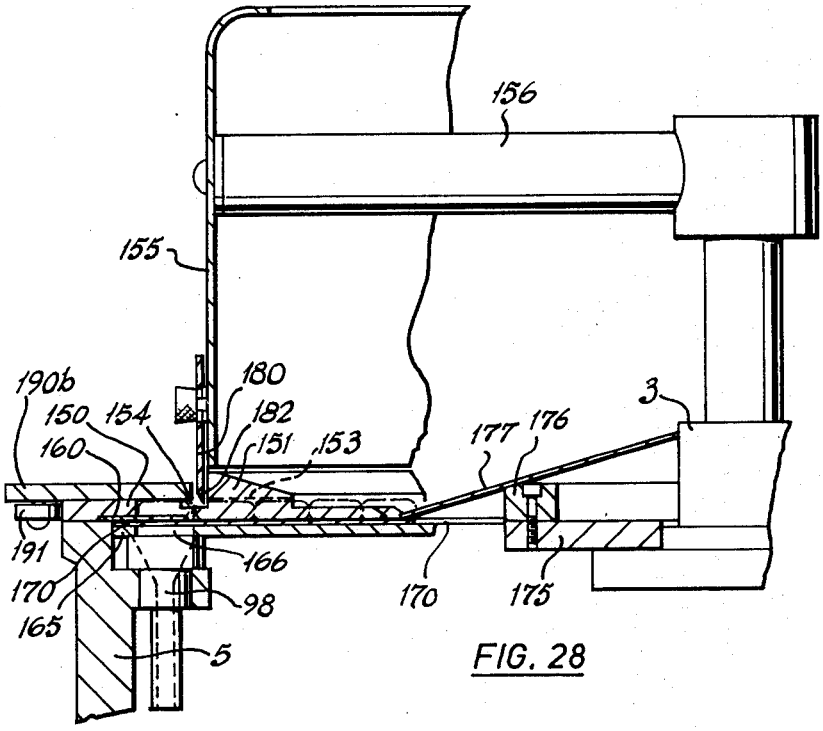
Figure 30:
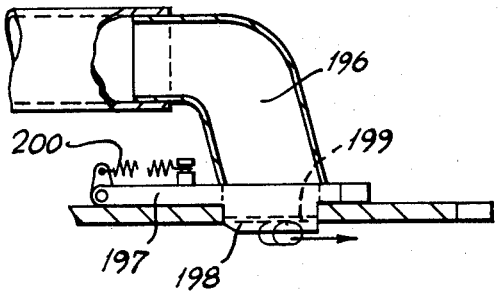
Figure 29:
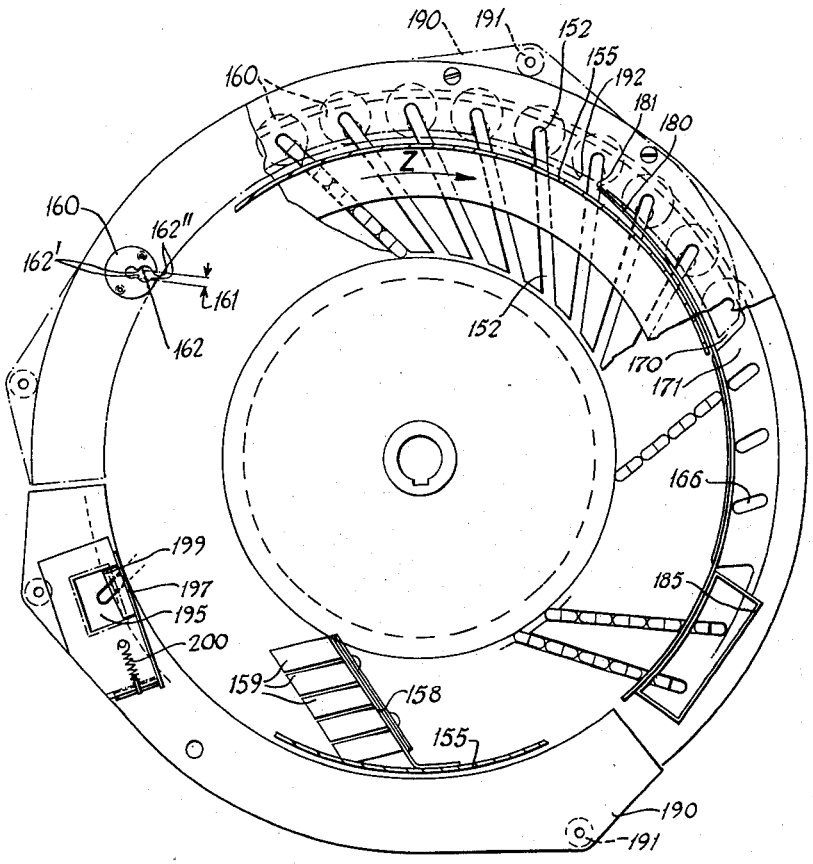

All these and still further features of this invention will become clear from the following description of specific embodiments of this invention which are described, by way of example, and not by way of limitation, with reference to the accompanying figures of drawing in which:

FIGS. 1, 2 and 3 are respectively a front, side and plan view of a machine according to this invention, FIG. 4 is a front sectional elevation showing the upper general assembly of the machine, FIG. 5 is a portion of FIG. 4 to a larger size, FIG. 6 is a view on line A—A in FIG. 5, FIG. 7 is a view on line B—B in FIG. 5, FIG. 8 is a plan view of the machine with the upper general assembly of the machine removed, FIG. 9 is a view on line C—C in FIG. 8, FIG. 10 is a view on line D—D in FIG. 8, FIG. 11 is a plan view, in part corresponding with FIG. 8, but including part of the upper general assembly of the machine, FIG. 12 is a view on line A—A in FIG. 11, FIG. 13 is a scrap view in the direction of arrow B in FIG. 11, FIGS. 14, 15 and 16 are views showing details of the capsule hopper and certain parts of the feed means for feeding empty capsules from the hopper, FIGS. 17 to 23 inclusive are views showing further details of the feed means for feeding empty capsules from the hopper, FIGS. 24 and 25 are diagrams illustrating the operation of the machine, FIGS. 26 and 27 show a modification to a part of the machine, and FIGS. 28 to 30 are views showing details of an alternative form of empty capsule hopper and feed means for feeding empty capsules from the hopper in a machine according to this invention.

In the following description the same reference numerals are used to indicate corresponding parts throughout the various figures of the drawings.

Referring to the accompanying drawings, the machine comprises a cabinet 1 housing motors, transmission and control gear. The cabinet top 2 forms the main structural member of the machine and at its centre it carries a stationary vertical centre column 3 at the upper end of which is concentrically mounted the non-rotating part of an empty capsule hopper 4 to be described later.

Immediately below the non-rotating part of the hopper 4 and running on bearings on the centre column 3 is a continuously rotating turret 5 the periphery of which is divided equally into thirty three sections at each of which is situated an upper punch holder 6, lower punch 7 and a capsule delivery tube 8. These members are all vertically reciprocable.

The upper punch holder 6 carries an upper punch 9 and reciprocates on the same vertical axis as the lower punch 7. The vertical axes of the upper punch holders and the lower punches lie on a common pitch circle centred on the axis of rotation of the turret 5.

The capsule delivery tube 8 carries a capsule delivery nozzle 10 and reciprocates on a greater pitch circle than the upper punch holder 6 and the lower punch 7, which is common to all the capsule delivery tubes and which is again centred on the axis of rotation of the turret 5.

Projecting radially inwards from each upper punch holder 6 is a shoulder screw 12 carrying two cam follower rollers 13, 14 which run in the track of a stationary upper cam assembly 11 centred and rigidly mounted on the fixed centre column 3. The capsule delivery tube 8 obtains its reciprocating motion from a forked crosshead 16 attached to the upper punch holder 6, but its length of stroke is restricted to less than that of the upper punch holder 6. Excess movement is absorbed by compression of an open coiled spring 17 co-axial with the delivery tube.

The lower punch 7 is headed at its lower extremity and is actuated in turn by a series of six cams 18, 19, 20, 21, 22 and 23 (see FIG. 8) secured to the cabinet top 2. Four of these cams 18, 20, 22 and 23 are fixed cams but the remaining two 19 and 21 have an adjustment for height this being effected in each case by a single control on a centrally located control panel 24 on the front of the cabinet 1. The first of these is the weight adjustment cam 19 which controls the amount of fill material to be place in each capsule. The second adjustable cam 21 is in the form of a roller and controls the degree to which each dose of fill is compressed to form a cylindrical slug before being ejected into the capsule body.

The centre portion of the rotating turret 5 is flanged to form a die table 25 which is correspondingly bored at each section of the turret to receive a die 26 and a capsule cap retaining cup 27 both of which are retained by pinch screws 28 and 29 respectively (see FIG. 7) so as to be readily exchangeable for a different die and cup to suit any different size of capsule to be filled.

The die 26 has a plain cylindrical bore of the same diameter as the upper and lower punches 9 and 7 which being co-axial with the die 26 are capable of entering it as shown in FIG. 4. The capsule cap retaining cup 27 has a stepped bore the upper part of which will accept a capsule cap but the lower diameter is reduced to accept the body of the capsule only. The capsule cap retaining cup 27 is co-axial with the capsule delivery tube 8 and nozzle 10 at the section and serves to limit their downward travel as shown in FIG. 4.

At each turret section, immediately below the die 26 and capsule cap retaining cup 27, and working radially in a guide 30 in the die table 25, is a transfer slide 32 which carries at its centre a readily exchangeable capsule body transfer cup 33 the bore of which is sized to accept the capsule body but a reduced diameter at its lower end prevents the body from passing right through. The transfer slide 32 is spring loaded outwards by means of a spring 36 and carries, at its outer end a roller follower 37 which contacts a stationary radical cam 38 which encircles the turret 5 and is supported from the cabinet top 2 by a cam support ring 40 and a spacer ring 42. This radical cam 38 is made in six segments for ease of assembly and forms a cover for the lower reciprocating parts 7 and 32.

The transfer slide 32 is reciprocated inwardly by the radical cam 38 and outwardly by the spring 36 in such a manner that the capsule body transfer cup 33 is alternately brought in line with the die 26 and the capsule cap retaining cup 27 as the turret 5 rotates. A clearance hole 43 is provided to allow the lower punch 7 to enter the die 26 when the transfer slide 32 is in its outer position.

To ensure that the transfer slide 32 always returns to its outer position, its outer end is provided with a dog **32*a* which normally clears the radially outer face of the cam ring 38 but which is engaged thereby to return the transfer slide to its outer position should it stick in its guide for any reason. The clearance hole 43 is always aligned with the lower punch 7 when the punch is advanced to enter the die 26** therefore and this ensures that jamming cannot occur between the punch and the transfer slide.

Attached to the turret 5 immediately below the transfer slides 32, and rotating with it, is an annular dust ring 45 having a series of vertical air holes 47 passing from its horizontal lower surface 48 and communicating with the lower ends of the capsule body transfer cups 33 when the transfer slides 32 are in their outer position. Surrounding each lower punch 7 is a pocket 50 which opens outwardly through the vertical circular wall 51 of the dust ring 45.

A stationary air and vacuum pocketed member 53, which is attached to the cam support ring 40, completely encircles the dust ring 45 with a closely controlled minimum clearance at the horizontal and vertical faces 54 and 55 respectively. Three segmental ports 56, 57 and 58 (see FIG. 8) in the upper horizontal surface of the member 53 are arranged to correspond with the vertical air holes 47, in the dust ring 45, and these connect with three pockets 60, 61 and 62 in the member 53, one of which, the pocket 60, is evacuated by a vacuum pump (not shown) whilst the other two pockets 61 and 62 are supplied with compressed air. The arc lengths and positioning of the segmental ports 56, 57 and 58 is such that they evacuate or pressurise the capsule body transfer cups during the appropriate period of turret rotation. Other pockets 64 (see FIG. 10) in the vertical wall 65 of the member 53 are connected as at 67 to external extraction equipment (not shown) for the purpose of removing waste fill material from the pockets 50 surrounding the lower punches 7.

The upper surface of the die table 25 is stepped, the inner part into which the dies 26 are set being higher than the outer part into which the capsule cap retaining cups 27 are set. This raised inner portion is bounded by a powder retaining band 69 and the annular area between this band and the throat of the turret 5 forms a trough 70 into which the fill material is fed via a rotary feeder 71.

The rotary feeder, which is a removable unit, is adjustably mounted to the cabinet top 2 and is driven from within the cabinet 1 by an infinitely variable speed motor (not shown) which can be controlled independently of the main turret drive. A fabricated paddle casing 72 housing a large feeder paddle 73, rotating in the horizontal plane, overhangs the die table 25 at an appropriate point for feeding, and an aperture 74 in the base of the casing allows the fill material to fall into a feed frame 76. The feed frame, which is an integral part of the paddle casing 72 is arranged to sit within the trough 70 and is adjusted to clear the surface of the die table 25 by a minimum amount. A recirculating band 77 attached to both ends of the feed frame 76 and passing around the throat of the turret 5 with spring loaded edge seals 77[1] allows surplus fill material exiting the feed frame to be carried around by the die table 25 inside the ring of dies and thereafter to re-enter the feed frame 76. Thus, the filled dies pass under a scraper blade 75 which deflects the surplus fill material inwardly, as the dies pass out from under the feed frame, into the throat of the turret inside the recirculating band. On again entering the feed frame, surplus fill material is moved outwardly over the dies by the feed frame.

The upper surface of the paddle casing 72 has, at a point diametrically opposite to the feed frame 76 an aperture 78 above which is a bowl 79 into which the neck of a hopper 80 projects. The hopper 80, for powdered or granular fill material, is supported by a tubular column 81 bolted to the cabinet top 2, as at 82, adjacent to the feeder 71.

Immediately before the feeder 71 in the direction of turret rotation indicated by the arrow Z and rigidly attached to the upper surface of one of the radial cam segments 38 is a capsule closing plate 83. This plate overhangs the outer part of the die table 25 over an arc of 45° in a manner such that the capsule cap retaining cups 27 pass beneath it. The clearance between the lower surface of the plate 83 and the surface of the die table 25 is at a minimum over the first 30° of plate length but a step 83' in the lower surface increases this clearance over the remaining portion.

A capsule delivery chute 84 is attached to the latter end of the closing plate 83 for the purpose of diverting filled and closed capsules away from the rotating die table 25 and into a suitable container (not shown) external to the machine. Compressed air issuing from a passage drilled in the closing plate 83 assists the capsules through the chute 84.

The main drive to the turret 5 of the machine is provided by a variable speed motor (not shown) mounted on the floor of the cabinet 1 and driving a worm reduction gearbox 85 by means of a timing belt. The gearbox 85 is bolted to the underside of the cabinet top 2 and its input shaft is provided with an extension carrying a handwheel 86 for setting purposes whilst its output shaft 87 extends vertically upwards through the cabinet top 2 and carries a pinion 88 at its upper end meshing with an internal gear ring 89 recessed into the base of, and fixed to the turret 5.

A flat, circular capsule orientation plate 90 is screwed to the top horizontal surface of the rotating turret 5 and turns with it. This plate 90 forms the floor of the empty-capsule hopper. It carries at its centre a cover in the form of a shallow cone 91 for the purpose of assisting the empty capsules towards the hopper wall. At each turret section, and on the same pitch diameter as the capsule delivery tubes 8, the orientation plate is pierced by an elongated aperture 92 of proportions such that it will clear the profile of an assembled capsule of a given size of capsules with its axis horizontal and tangential to the pitch circle. These apertures 92 are generously chamfered at their upper edges, as at 93, especially at their inner sides 94.

Permanently fastened to the lower side of the orientation plate 90 at each aperture is a thin disc 95 with an aperture 96 of similar proportions but reduced in width to a size such that it will pass the body of a capsule of the given size but not the cap. The centre portion 97 of the aperture 96 is relieved over approximately a third of the total length to the full width of the aperture 92 in the orientation plate 90.

A capsule receiving cup 98 the top of which is a short distance below the orientation plate 90 is secured in the rotating turret 5 at each turret section and a tubular stem 99 at the lower end of the cup enters the upper end of the capsule delivery tube 8 which is capable of reciprocating over it. The cup 98 is coned internally, as at 100, the larger diameter upper end being of a diameter sufficient to accept an assembled capsule in a horizontal attitude.

A non-rotating timing plate 101 which is rigidly supported from the fixed centre column 3 with a minimum clearance between its upper surface and the underside of the orientation plate 90 has an edge portion 102 of reduced thickness which projects into the space between the plate 90 and the tops of the capsule receiving cups 98 so as normally to prevent capsules from falling into the cups. At the appropriate point, relative to the cycle of the machine, and later to be described, a section 103 is removed from the edge portion 102 of the timing plate to allow capsules to pass from the empty-capsule hopper into the delivery tubes 8 via the apertures in the orientation plate 90 and the receiving cups 98.

The part of the empty-capsule hopper 4 which as previously mentioned, does not rotate, is of circular sheet metal construction and is concentricly supported from, and on top of, the centre column 3. The main wall 104 of this part is of a diameter such that its lower edge 105 just embraces the ring of capsule shaped apertures 92 in the orientation plate 90 and a small but adjustable clearance exists between the two. An inner wall 108 concentric with the main wall but of a smaller radius extends around the inside of the hopper for 80° and its ends are extended as at 106 and 107 to meet the main wall 104, both walls 104 and 108 being the full height of the hopper. The radius of the curved part of the inner wall is such that the apertures 92 in the orientation plate 90 pass round the outside of it, the main outer wall 104 being cut away locally, as at 109, over this arc.

At this region 109 where the apertures 90 make the transition from the inside to the outside of the hopper a brush housing 110 is accommodated in which a cylindrical brush 111 rotates with its axis 112 horizontal and tangential to the inner wall 108. The lower part of the brush 111 lightly contacts the orientation plate 90 the upper part of the brush being shielded inside the hopper, and continuous rotation is provided from the main turret drive gearbox 85 by means of a timing belt (not shown) to a vertical shaft 113 passing upwards through the cabinet top 2. A universally jointed shaft 114 transmits the drive from the shaft 113 to the capsule hopper where a pair of crossed helical gears 115, 116 inside the brush housing 110 complete the train. The direction of rotation of the brush 111 is such that capsules which are horizontally seated in the orientation plate apertures 92, may leave the hopper unimpeded but all others will be brushed back radially towards the centre of the machine. A deflector plate 118 projecting into the hopper from the brush housing 110 ensures a relatively capsule free area into which any mis-located capsules will be brushed before re-entering the main mass in the hopper.

The angular relationship between the capsule hopper and the timing plate 101 is such that the latter prevents capsules in the hopper from proceeding any further than a horizontal position in the apertures 92 in the orientation plate 90 but having left the interior of the hopper via the rotating brush 111 they approach the cut away section 103 of the timing plate 101 where they are free to fall into the capsule receiving cups 98.

A suction duct 120 which forms an integral part of the empty-capsule hopper is arranged above the path of the capsule apertures 92 immediately following the cut out 103 in the timing plate 101 the purpose of this being to remove capsules which have not fallen through, possibly due to damage, and so prevent them from re-entering the hopper 4. Any capsules rejected in this manner are prevented from entering the extraction system by a trap 121 which is flange mounted to the outside of the empty capsule hopper and is easily removable for emptying.

In order that the machine may handle all the standard capsule sizes only the following parts need to be changed:

The orientation plate 90
The capsule receiving cups 98
The capsule delivery nozzles 10
The capsule cap retaining cups 27
The capsule body transfer cups 33
The upper punches 9
The lower punches 7, and
The dies 26.

Referring now to FIGS. 24 and 25, these diagrammatically illustrate the operation of the machine. FIG. 24 illustrates the single rotary phase of the machine in which the empty capsules are fed successively from a random bulk supply of the capsules in the empty capsule hopper, uncapped, filled with a slug of fill foamed from fill material fed from the hopper 80 by the rotary feeder 71 on to the die table, re-capped, and then ejected from the machine. The adjacent radial lines in this figure define angles of 10° of rotation of the turret 5 in the single rotating phase of the machine.

FIG. 25 illustrates from left to right in the figure the same successive steps of forming a slug of fill material, feeding an empty capsule from the random bulk supply of empty capsules in the empty-capsule hopper, uncapping the capsule, filling the capsule with the slug of fill material, recapping the capsule, and finally ejecting the capsule from the machine. It should be noted that FIG. 25 is marked with vertical lines defining, between adjacent lines, 10° of rotation of the turret 5 and that the angles marked along the top of FIG. 25 correspond with the angles marked around FIG. 24, the line "0°" indicating the front of the machine which lies at the bottom in the diagram of FIG. 24. It should also be noted that each section of FIG. 25 is turned through 90° about the axis of the capsule delivery tube 8, except in respect of the showing of the parts of the empty-capsule hopper at the top of each section of the figure respectively.

In operating the machine the rotary feeder 71 and the turret 5, which rotates in the clockwise direction of arrow Z when viewed from above, are set in motion, the fill material hopper 80 and empty-capsule hopper 4 having previously been filled respectively with powdered or granulated material and empty but assembled hard-gelatin capsules.

The majority of the capsules lying on the orientation plate 90, which also forms the floor of the empty-capsule hopper, will assume a horizontal attitude due to contact with the plate, and will be urged towards the outside wall of the hopper both by their own weight acting on the conical centre cover and by the effect of centrifugal force. The reaction of the hopper wall to this outwards movement tends to turn the capsules into an attitutde conducive to their entry into the orientation plate apertures 92 and the relative movement between the wall and plate assisted by the chamfers surrounding the apertures ensure that a high percentage of the latter are occupied by capsules. The presence of the stationary timing plate 101 below the orientation plate 90 causes the capsules to remain in the apertures and travel in a circular path around the inside of the empty-capsule hopper to a point of exit where the rotating brush 111 is situated.

Capsules which are horizontally located in the apertures and resting on the timing plate 101 will not project above the upper surface of the orientation plate 90 and will therefore pass out of the hopper, under the rotating brush without making contact with it. This occurs when the turret has rotated 210° from the front of the machine. Incorrectly located capsules will be either re-seated by the action of the brush or, in extreme cases lifted from the apertures completely and returned to the hopper. Capsules not occupying apertures but resting on the upper surface of the orientation plate 90 are deflected radially inwards as they approach the exit point by the deflector plate 118 which apart from providing a clear area into which the brush 111 may re-direct misaligned capsules with the minimum of resistance, also imparts a mild agitation to the main mass of capsules in the empty-capsule hopper so assisting the complete filling of the apertures 92.

Having left the empty-capsule hopper in the above manner the empty capsules, which are now isolated in individual apertures 92 and free of the influence of the remaining mass, proceed in their horizontal attitude toward the cut away section 103 of the timing plate 101. This is reached when the turret has rotated 250° from the front of the machine. The angular positioning and length of the cut away section coincides with those of the first segmental port 56 in the air and vacuum pocketed member 53 which being connected to the vacuum pump, will draw air downward from the orientation plate 90 via the receiving cups 98, delivery tubes 8 and nozzles 10, the latter being in contact with the cap retaining cups 27 as each successive turret section enters this phase of rotation. The transfer slides 32 are in their outer positions during this period allowing free passage of air between the cap retaining cups 27 and dust ring 45 via the capsule body transfer cup 33.

As the horizontal capsules, travelling with the orientation plate pass over the cut away portion of the timing plate which extends from 250° to 290° of the turret rotation from the front of the machine they will no longer be supported from below and will attempt to fall under their own weight and the influence of suction from the receiving cups 98 but the width of the aperture 96 in the orientation discs 95 is restricted at each end to a size capable of passing the capsule body only. Irrespective of whether a capsule's cap was leading or trailing during horizontal travel, the body end will fall first, being free to do so, but the cap, being greater in diameter, will be delayed by the restricted gap width and will pivot on two points 96' or 96'' at the end of the restriction finally following the body end through the centre portion 97 of the aperture 96, the capsule having assumed a vertical attitude.

Contact with the conical inner wall of the capsule receiving cup 98 maintains the capsule in this vertical attitude and assists its entry into the neck of the cup from where it is drawn rapidly downwards through the delivery tube 8 and nozzle 10 by suction and enters the cap retaining cup 27. The capsule cap having entered the cup sufficiently to ensure that its head is below the surface of the die table 25 is prevented from proceeding any further by the step in the cup bore, but the capsule body, still under the influence of the vacuum pump, and assisted by its own momentum, separates from its cap and continues downwards through the cap retaining cup 27 and into the capsule body transfer cup 33 where, its descent is arrested by the reduced lower bore diameter of this cup.

If the capsule body fails to separate from its cap, the capsule is retained wholly within the cup 27 without projecting from it at its lower end is finally ejected from the machine along with the filled capsules and thereafter separated from them by suitable external equipment. In this way a capsule which fails to become uncapped in the machine is prevented from jamming the machine.

At this point in the cycle of the machine the upper punch 9 and the lower punch 7 are entered in the die 26 and between their tips a lightly compressed slug containing the required amount of fill material is in the final stage of formation, the preceding stages beginning at the left hand end of FIG. 25 proceeding through an angle of about 157° of turret rotation.

The paddle in the rotary feeder 71 transfers fill material from the hopper 80 to the feed frame 76 which is maintained in the full condition, fill material surplus to demand rotating within the paddle casing 72 until required. As the dies 26 enter the feed frame 76, which as may be seen from FIG. 24 embraces an arc of approximately 80°, their bores are completely occupied to the surface of the die table 25, by the tips of the lower punches 7 which, at this point, at about 80° of rotation of the turret from the front of the machine, are at the upper limit of their stroke. This is illustrated in the first step at the left hand end of FIG. 25. The upper punch 9 and capsule delivery nozzle 10 which perform no function at this stage are also at the upper limit of their strokes, and remain there while passing over the feed frame 76. FIG. 25 illustrates in chain dotted lines the vertical position of the lower punches, the upper punches and the capsule delivery tubes carrying with them the capsule delivery nozzles respectively throughout 360° of rotation of the turret 5. During the first 40° of travel through the feed frame a quantity of fill material in excess of requirements is drawn into each die 26, by suction and by gravitational action upon lowering of the punches 7 which, have entered the feed frame, are caused to descend until their tips are barely entered in the lower end of the dies 26. This is achieved by the cam 18, termed the lowering cam, which pulls down the lower punches to the position illustrated in the second step in FIG. 25. At this point the punch heads at the lower end of the punches 7 leave the lowering cam and come into contact with the weight adjustment cam 19 which causes them to rise again, to a height which has been preset at the control panel 24, so ejecting a quantity of fill material back into the feed frame 76, the trailing edge scraper 75 of which removes the surplus to leave an accurately metered dose in each die 26.

The material removed from the dies 26 creates, within the feed frame 76, an excess of fill material which passes between the recirculating band 77 and the throat of the turret 5 travelling with the latter to re-enter the feed frame on demand. It should be noted that the surface of the die table 25 is free of fill material except for the areas within the feed frame 76 and inside the recirculating band 77. This ensures that the accurately measured dose of fill material in each die cannot be supplemented outside the feed frame.

As each turret section completes its traverse of the feed frame 76 the upper punch holder 6 and punch 9 start to descend and continue to do so over the next 40° of turret rotation, bringing with them the capsule delivery tube 8 and nozzle 10. As this descent proceeds the lower punch 7 is lowered a small amount by the cam 20, termed the pull down ramp, to prevent spillage of fill material from the die 26 during entry into the die of the upper punch 9, downward travel of which ceases when the capsule delivery nozzle 10 contacts the capsule cap retaining cup 27. These steps are illustrated in the third and fourth steps in FIG. 25.

Compression of the dose of fill material commences as the upper punch 9 enters the die 26 and continues as the lower punch 7 passes over the compression roller 21, the height of which has been preset at the control panel 24 to provide the minimum degree of compression necessary to ensure that the slug of fill material will remain in the die 26 when the lower punch 7 is lowered.

It is during this compression stage that capsule separation takes place, as previously described, after which the capsule body is located in the capsule body transfer cup 33 within the transfer slide 32 as illustrated in step 5 of FIG. 25.

Following compression, the heads at the lower ends of the punches 7 contact the cam 22, termed the retraction cam, and the lower punches are caused to descend over a period of turret rotation of 70°, to the lower limit of their stroke, leaving the transfer slides 32 unobstructed and the latter, carrying the transfer cups 33 containing capsule bodies, are moved to their inner position by the track of the radial cam 38. This movement is illustrated by the open headed arrow in step 5 of FIG. 25 and, the inner position of the transfer slide, in step 6 of FIG. 25. Also, FIG. 24 indicates in chain dotted line, the respective paths of each capsule body and each capsule cap during 360° of rotation of the turret and indicates the separation of each body and cap during 60° of rotation of the turret approaching the front of the machine and 10° of rotation of the turret passed the front of the machine.

Having reached its inner position, the capsule body contained within each transfer slide 32 is directly below the pre-formed slug which is still retained in the die 26 and at this point a further downward movement of the upper punch 9 ejects the slug into the capsule body, the former being of smaller diameter than the latter. This is illustrated in step 6 of FIG. 25. In the event of a capsule body not being present in the capsule body transfer cup 33, the slug of material will pass right through the cup into the pocket 50 which surrounds the lower punch tip from where it is drawn into one of the vacuum pockets 64 of the member 53 and may, with the use of suitable extraction equipment, be reclaimed. The compression of each slug is made sufficiently light so that the slug will disintegrate on contact with either the inside of a capsule body or, if there is no capsule body, the interior surface of the pocket 50.

The upper punch 9 and capsule delivery nozzle 10 now return to the top of their strokes in preparation for passing over the feed frame 76 on the next revolution of the turret 5 and the transfer slide 32 returns to its outer position allowing the lower punch 7 to be fully raised by the cam 23, termed the lower lifting cam. This is illustrated in steps 7 and 8 of FIG. 25.

The filled capsule body at each succesive turret section, having been returned by its transfer slide 32 to a position immediately below the cap retaining cup 27, now approaches the second segmental port 57 in the upper horizontal surface of the member 53. Compressed air from this port enters the lower end of the capsule body transfer cup 33 via the vertical holes 47 in the dust ring 45 and forces the filled capsule body vertically upwards into the cap retaining cup 27 which contains the cap so as to re-cap the capsule body with its original cap and with the cap in its original orientation on the body. At this point of turret rotation the cap retaining cup has commenced to pass beneath the capsule closing plate 83. As the capsule body starts to enter the cap some upward movement of the latter will occur but will be limited by contact with the capsule closing plate 83 the arc length of which coincides with that of the segmental port 57, pressure being maintained below the capsule over this arc length. The step 83' towards the letter end of the lower surface of the closing plate 83 allows the capsule a small upwards acceleration which is abruptly arrested by renewed contact with the raised lower surface of the plate 83, thus ensuring complete closure.

Upon further turret rotation, each cap retaining cup 27 emerges from beneath the capsule closing plate 83 and air issuing from the third segmental port 58 in the member 53 ejects the capsule into the capsule delivery chute 84 where, assisted by the fixed air jet, it is diverted away from the die table and into a suitable container.

FIG. 24 clearly illustrates the various stations in the single, continuously rotating phase of the machine. These, of course, are the fixed stations defined by the machine in the path of the turret sections, as the turret rotates 360°. Each station extends over arc of rotation of the turret. Thus, beginning at an angle of 85° of turret rotation from the front of the machine, over the next 70° of rotation of the turret each die 26 enters the feed frame 76 and is fully charged with fill material as its lower punch 7 descends. Over the next 25° of rotation of the turret the lower punch is raised by the weight adjusting cam 19 to eject surplus fill material. Over the next 50° of rotation of the turret the lower punch descends a small amount to prevent spillage from the die 26 and the upper punch 9 descends and enters the die. Over the next 20° of rotation of the turret the slug of fill material is compressed in the die. Over the next 50° of rotation of the turret the lower punch descends to clear the radial transfer slide 32 leaving the slug in the die. Over the next 20° of rotation of the turret a capsule body is transported inwards by the radial slide 32 to a position under the slug. Over the next 30° of rotation of the turret the upper punch 9 descends and ejects the slug into the capsule body. Over the next 20° of rotation of the turret the radial slide 32 returns the filled capsule body to a position under the cap retaining cup 27. The turret then rotates a further 10° to bring the aligned cap and body under the closing plate 83. Over the next 45° of rotation of the turret compressed air from the closing port 57 returns the filled capsule body into its cap. Over the next 15° of rotation of the turret compressed air from the ejecting port 58 lifts the closed capsule into the ejection chute 84. After a further 5° rotation of the turret the cycle then repeats. Over an arc of rotation of the turret extending through an angle of 35° up to the front of the machine and an angle of 220° from the front of the machine empty capsules inside the hopper 4 may enter the apertures 92 in the orientation plate 90. Over the next 30° of rotation of the turret correctly seated empty capsules pass beneath the rotary brush 111 and leave the inside of the hopper 4. Over the next 40° of rotation of the turret the empty capsules fall through the capsule delivery tubes 8 and their bodies separate from their caps. Over the next 30° of rotation of the turret the suction duct 120 removes any capsules failing to orientate and fall through the apertures 92. Thereafter after a further 5° of rotation of the turret the apertures 92 re-enter the hopper 4 and the empty capsule feeding cycle then repeats.

The cams 19 and 21 are adjustable each as to height by its separate single control on the panel 24 regardless or not of whether the machine is running to adjust the dose and the degree of compression of each slug of fill material. Each dose is accurately measured in the dies 26 and is accurately repeated from one die to the next.

In a modification illustrated in FIGS. 26 and 27, in order to deal with capsules which open to the point of separation of their body and cap, as shown in FIG. 26, but in which trimming burrs on one or other of these parts prevent them from totally separating, transfer cups 133 of lesser depth than the capsule bodies are substituted, each having an upper surface which is upwardly inclined in the radial outward direction of the cup, this surface constituting a ramp 134 capable of lifting such an unseparated capsule driving inward movement of its slide 32, as previously described, this lifting movement being continued by a ramp slot 135 in the slide but extending in the direction of movement of the slide, from the outer radial edge of the ramp 134 to the upper surface 136 of the slide, so as to force back the body of the capsule entirely into the capsule cap retaining cup 27, as shown in FIG. 27. This prevents the body of a partially separated capsule being severed between its transfer cup and its cap retaining cup when the slide moves inwardly, thus blocking the station and necessitating a stoppage of the machine. The capsule is thereafter ejected from the machine as previously described, the capsule, if necessary, being first fully reclosed as it passes beneath the plate 83.

In the alternative arrangement of FIGS. 28 to 30, there is provided, rigidly attached to the upper surface of the turret 5 and rotating with it a capsule feed plate 150 which replaces the earlier orientation plate 90. The capsule feeding plate 150 is in the form of an annulus the general thickness of which is equal to the diameter of the capsules to be fed, but a central band 151 of greater thickness extends from the upper surface towards the base of the non-rotating cylindrical sheet metal hopper wall 155. Thirty three slots 152, one per turret section, penetrate the thinner part of the plate and pass from the inner diameter to a point beyond the pitch circle of the capsule receiving cups 98. The slots 152 are straight and all equally inclined from their inner to their outer ends, rearwardly with respect to the direction of rotation Z of the turret 5. The width of each slot is such that a capsule, in a horizontal attitude, can pass freely along it to its outer end at which point the capsule will be centrally disposed above a capsule receiving cup 98. The thickened central band 151 of the capsule feeding plate 150 provides a roof over the slots 152 so forming passageways 153 through which the capsules leave the hopper. The upper surface of the thickened central band 151 is conical to prevent capsules lodging on it.

A shallow circular recess is provided at each turret section in the lower surface of the capsule plate 150 and rigidly fitted into each recess is an orientation disc 160 the function of which corresponds with that of the orientation disc 95 previously described. Each disc 160 has a slot 161 which is open-ended and of a width sufficient to pass the body of the capsule but not its cap. The slot 161 is aligned with the slot 152 at the section with its open end innermost to allow entry of a capsule from the slot 152 into the slot 161. A portion 162 of slot 161 in the disc 160 is relieved to a diameter sufficient to allow the capsule to pivot and pass the capsule cap. This portion 162 is concentric with the capsule receiving cup 98 at the section.

Below the capsule feeding plate 150 and separated from it by a small gap of 0.5 mm to 1.0 mm is a diaphragm support plate 165 which also rotates with the turret 5 and is supported by the heads of capsule receiving cups 98. This plate, has at each section, a slot 166 which is capable of passing a capsule in the horizontal attitude, the slots being disposed at the same angle and immediately beneath the slot 152 with its centre on the axis of the capsule receiving cup 98 at the section.

A thin, flexible, sheet metal or plastics material diaphragm 170 occupies the gap between the capsule feeding plate 150 and the diaphragm support plate 165 and is slidably supported on the latter. The diaphragm 170 which does not rotate with the turret is anchored to the centre column 3 by means of a diaphragm anchor plate 175 and clamping ring 176. A portion of the outer periphery of the diaphragm 170 is cut away, as at 171 to allow the release of capsules from slots 161. The centre portion of the diaphragm 170, together with the diaphragm anchor plate 175 and the clamping ring 176, are covered by a non-rotating conical floor which presents a smooth upper surface which is downwardly inclined from the centre towards the outside of the hopper floor and encourages the capsules to move outward towards the capsule feeding plate 150.

The hopper wall 155 is supported from the centre column 3 by a spider 156 to provide a small but adjustable gap 157 between its lower edge and the upper surface of the band 151. Three deflectors 158 one of which is shown in FIG. 29, are attached to the inside of the hopper wall and project inwardly and forwardly with respect to the direction of rotation Z. Each deflector 158 carries at its lower edge a number of flexible rubber fingers 159 which are arranged to trail over the slotted upper surface of the capsule feeding plate 150 between the inner diameter of the latter and the conical surface of the thickened central band 151.

Secured to the outside of the wall 155 is a capsule retraction blade 180 which extends over an arc of approximately 120° embracing towards its centre the arc of the cut away portion 171 of the diaphragm 170. The radius of the blade 180 diminishes in the direction of turret travel Z up to the beginning of the cut away portion 171 but from this point onwards its radius remains constant, closely following the outside of the hopper wall 155. The radial position of the leading edge 181 of the blade 180 with respect to the rotation direction Z is adjustable as also is the height of the lower edge 82 of the blade, which edge is thinned and polished. The upper surface of the capsule feeding plate 150 has a full circular shallow groove 154 into which this edge 182 projects without actually making contact with the plate.

A duct 185 which is connected to the external extraction equipment is attached to the outside of the hopper wall 155 at a position immediately following the cut away portion 171 and a small clearance exists between the lower edge of this duct and the upper surface of the capsule feeding plate 150.

Two similar non-rotatable segmental cover plates **190*a* and 190*b* rest on the upper surface of the capsule feeding plate 150 and between them occupy an arc extending, in the direction of rotation Z, from the duct 185 to the beginning of the cut away portion 171. These cover plates are flexibly anchored to the wall of the hopper 155 by means not shown and are lightly spring biased downwards and radially inwards thereby, the latter bias being resisted by guide rollers 191 on the plates which run in engagement with the peripheral edge of the capsule feeding plate 150. The cover plates 190*a* and 190*b* just clear the thickened central band 151 of the capsule feeding plate 150 at their inner edge and local clearances also provided as at 192 between plate 190*b* and the retraction blade 180 to prevent interference with the blade. The cover plate 190*a* has, near its trailing end with respect to the rotation direction Z, a rectangular aperture 195 above which is a second duct 196 which is connected to the external extraction equipment via a branch pipe on the first duct 185. A hinged blade 197 which is lightly spring biased downwards by means of a coiled tension spring 200 is positioned at the radially inner side of the rectangular aperture 195 and a tongue 198 which is an extension of the lower edge of the blade 197 which projects into the groove 194.**

The blade 197 also has a horizontal extension 199 which normally rests on the upper surface of the capsule feeding plate 150 and occupies an area within the aperture 195 extending outwards from the blade 197 to the pitch circle of the capsule receiving cups 98.

In the operation of the feed means last described with reference to FIGS. 28, 29 and 30, a proportion of the mass of capsules within the hopper rests on the capsule feed plate 150 and relative movement between the latter and the non-rotating parts of the hopper including particularly the deflectors 158 and their fingers 159 encourages capsules to enter and take up a horizontal attitude in the slots 152, resting upon the stationary diaphragm 170. The movement of the plate 150 with respect to the diaphragm 170 then causes these capsules to roll about their own longitudinal axes in the clockwise direction as viewed looking outwardly from the centre along the slots 152, and this rolling action, coupled with the angular disposition of the slots 152 with respect to the radial direction causes the capsules to move outwardly along the slot until their further outward movement is prevented, in the case of the leading capsule by contact between it and the outer end of the slot, and in the case of the next following capsule by contact between it and the leading capsule when the leading capsule is engaged in the outer end of the slot, and so on. This outward movement of the capsules in each slot 152 is brought about by the fact that the drag applied to each capsule by the diaphragm causing it to roll, applies the capsule against the trailing side wall of the slot 152 with a force having a component normal to that wall and a component acting outwardly along the wall.

A leading capsule engaging the outer end of any one slot 152 is symmetrically disposed about the axis of a capsule receiving cup 98. To arrive at this outer end position the capsule has to pass out under the hopper wall 155 via the passageway 153 associated with the slot. Leading capsules at the outer limit of their travel are still subject to the rolling action already described but as their further outward movement is prevented, there is a tendency for them to lift and the function of the cover plate 190*a* and 190*b* is to check this tendency.

The angular extent and positioning of the cut away portion 171 of the diaphragm 170 coincides with that of the vacuum port 56 previously described and the body of leading capsule, at the outer limit of its travel, on entering this sector, is therefore free to fall, under the influence of gravity and suction, through the slot 161, the capsule cap pivoting on the two points 162' or 162'' so that the capsule turns from its horizontal attitude into a vertical attitude and the capsule cap follows the capsule body through the portion 162 of the slot 161 in the orientation disc 160 and the clearance slot 166 in the diaphragm support plate 165 into the capsule receiving cup 98 where it proceeds through the machine cycle as previously described.

To assist in ensuring that a capsule will orientate cleanly from its horizontal attitude to its vertical attitude in the manner just described it is desirable to remove the end pressure generated upon it by the rolling action of the succeeding capsules in the same slot 152. This is the function of the stationary capsule retraction blade 180. The leading edge 181 of the blade adjusted radially to enter the waist formed between the domed inner end of the leading capsule and the domed outer end of the next following capsule, the lower edge 182 being set vertically to a constant height such that it penetrates between the capsules as deeply as possible without making contact with the base of the groove 154. As the radius of the blade 180 diminishes, rotation of the turret 5 causes the second and all subsequent capsules in each slot to be pushed back by a small amount and retained in this retracted position leaving the leading capsule free of any hampering influences. Following capsules are maintained retracted by the blade 180 during rotation of the slot under the extraction duct 185 so that a capsule which has failed to orientate and descend into the capsule receiving cup due to it being damaged or due to the presence of a second cap on the other end of the capsule body for example will be removed by the external extraction equipment but the following capsules will be prevented by the blade 180 from being sucked up into the duct 185.

After passing the trailing end of the capsule retraction blade 180, capsules which have been retained by the latter are again freed to move radially outwards, the leading capsule to occupy the now vacant outer position for orientation during the next revolution of the turret 5.

Any incomplete capsule i.e. a capsule body without a cap or a free cap not capping a body, moving to this outer position is a potential hazard to the uninterrupted running of the machine as it can block a section if allowed to continue on its way. Also a complete capsule following an uncapped capsule body or a cap without a body, being incorrectly positioned too far outwardly in radial direction with respect to the leading edge of the blade 180 will be damaged as it passes under that leading edge instead of behind it. To prevent this occurrence it is necessary to remove any separate capsule bodies or capsule caps moving into the outer position before they reach the leading edge of the blade 180 and this is the function of the extraction duct 196 near the trailing edge of the cover plate 190*a*.

The hinged blade 197 differentiates between a complete and an incomplete capsule. When a complete capsule occupying the outer end of the slot 152 passes beneath the rectangular aperture 195 the tongue 198 enters the waist formed between the domed inner end of the capsule and the domed outer end of the next following capsule. No movement of the hinged blade 197 takes place and the complete capsule is prevented from lifting into the extraction duct 196 by the horizontal extension 199 which rests on the upper surface of the capsule feeding plate 150.

When an incomplete capsule occupies the outer end of the slot 152 the next following capsule takes up a position nearer to the outer end of the slot 152 than would normally be the case due to the shorter length of the incomplete capsule. Tongue 198 contacts this second capsule and is caused by the latter to lift, raising the hinged blade 197 against the action of the spring 200. The horizontal extension 199, being rigidly attached to the blade 197, also lift, allowing sufficient clearance for the incomplete capsule to be lifted by suction into the duct 196 and drawn off into the external extraction equipment. The circumferential length of the aperture 195 is such that it cannot be occupied by more than one section at a time so preventing the possibility of a complete capsule being removed in the duct 196 during the passage of a half capsule in the adjacent section.

Machines as described are capable of an output of filled capsules in excess of 2,000 per minute.

In as far as the machines are of the slug forming type they are not suitable for filling capsules with pelletised material which cannot acceptably be crushed.

What is claimed is:

1. A hard-gelatin capsule filling machine for filling two piece capsules comprising:

an uncapping station for uncapping capsule, means for compressing a quantity of fill into a soft slug, a filling station for inserting the slug into the bottom part or body of the capsule, a re-capping station for recapping the body part, and an ejection station for thereafter ejecting the filled capsule in a single, continuously rotating phase of the machine;

said filling station comprising fill forming means including at least one die mounted between upper and lower punches for forming each slug of fill and for delivering the formed slug of fill into a capsule body through the lower end of the die by the upper punch;

said fill forming means further including a single rotatable turret, which is continuously rotated in use of the machine, the turret comprising a die table having a ring of dies lying on a common pitch circle centered on the axis of rotation of the turret with their axes parallel with the axis of rotation of the turret, and for each die an upper punch movable into and out of the upper end of said die, and a lower punch movable into and out of the lower end of said die; and cam means for reciprocating the lower punches as the turret rotates to advance each lower punch from a withdrawn position relative to its die, into its die to a first position therein in which its tip lies flush with the upper end of the die, thereafter to withdraw the punch to a second position in its die to assist in drawing fill from the die table into the die, thereafter to advance the punch to a second position in its die to eject a quantity of fill from the die and leave a predetermined metered dose of fill in the die, thereafter to withdraw the punch to a third position in its die to prevent spillage of the metered dose of fill material from the die during movement of the upper punch associated with the die into the upper end of the die, thereafter to advance the punch to a fourth position in its die to form a soft slug of the metered dose of fill material in the die and thereafter to return the punch to said withdrawn position.

2. A machine as claimed in claim 1 further comprising means for feeding a series of capsules successively from a bulk supply of the capsules to said uncapping station in said single continuously rotating phase of the machine, the capsule bodies being filled, re-capped and ejected at following, successive stations in the single, continuously rotating phase.

3. A machine as claimed in claim 2 wherein the capsule feeding means comprises a circular array of capsule delivery tubes, disposed in said single rotating phase of the machine and arranged to feed the empty capsules downwardly, singly in succession, to the uncapping station, cap uppermost, each through a succeeding one of the capsule delivery tubes.

4. A machine as claimed in claim 3 further comprising an empty capsule hopper for random bulk supply of capsules disposed above said circular array of capsule delivery tubes, and said capsule feeding means feeds capsules in succession from the hopper to the delivery tubes at a station in advance of said uncapping station in said single continuously rotating phase of the machine.

5. A machine as claimed in claim 2 wherein the filling station is disposed at a lesser radius than the feeding, uncapping and re-capping stations in said single continuously rotating phase of the machine, and each capsule body is moved radially inwardly to pass through the filling station, after it has been uncapped, and thereafter radially outwardly to pass through the re-capping station.

6. A machine as claimed in claim 1, further comprising a hopper for fill material, a rotary feeder for feeding fill from the hopper, and a stationary feed frame positioned over the die table so as to be traversed by said ring of dies, said feed frame being arranged to receive fill material from said rotary feeder and carrying a scraper blade to deflect surplus fill material leaving one end of the feed frame inwardly so that it is carried round on the die table inside the ring of dies, the surplus fill material re-entering the feed frame at its opposite end.

7. A machine as claimed in claim 6, further comprising a re-circulating band having its ends connected respectively to opposite ends of the feed frame for containing the surplus fill material on the die table inside the ring of dies.

8. A machine as claimed in claim 1, further comprising additional cam means for reciprocating the upper punches as the turret rotates, to advance each upper punch from a withdrawn position relative to its die, into its die to a first position therein, thereby to form a soft slug of fill material in the die, thereafter to advance the punch to a second position in its die to deliver the slug of fill material from the die, and thereafter to return the punch to said withdrawn position.

9. A machine as claimed in claim 1, wherein said cam means is adjustable to adjust the second position of each lower punch in its die thereby to adjust the metered dose of fill retained in the die.

10. A machine as claimed in claim 1 wherein said cam means is adjustable to adjust the fourth position of each lower punch in its die thereby to adjust the degree of compression of each slug of metered dose of fill material formed in the die.

11. A machine as claimed in claim 8, wherein said additional cam means comprises cam follower means carried by upper punch holders, one for each upper punch, the cam follower means co-operating with a stationary upper cam assembly having a track centred on the axis of rotation of said turret to advance and withdraw the upper punches.

12. A machine as claimed in claim 1, wherein said cam means comprises a series of six stationary cams which co-operate directly with heads at the lower ends of the lower punches to advance and withdraw the lower punches.

13. A machine as claimed in claim 9, wherein said cam means comprises a series of six stationary cams which co-operate directly with heads at the lower ends of the lower punches to advance and withdraw the lower punches and one of said cams constitutes a weight adjustment cam which is individually adjustable thereby to adjust the metered dose of fill retained in each die.

14. A machine as claimed in claim 10 wherein said cam means comprises a series of six stationary cams which co-operate directly with heads at the lower ends of the lower punches to advance and withdraw the lower punches and one of said cams is in the form of a roller which is individually adjustable thereby to adjust the degree to which each dose of fill is compressed to form a cylindrical slug from the metered dose of fill retained in the die.

15. A hard-gelatin capsule filling machine for filling two piece capsules comprising:

an uncapping station for uncapping a capsule, means for compressing a quantity of fill into a soft slug, a filling station for inserting the slug into the bottom part or body of the capsule, a re-capping station for recapping the body part, and an ejection station for thereafter ejecting the filled capsule in a single, continuously rotating phase of the machine;

a feeding station including means for feeding a series of capsules successively from a bulk supply of the capsules to said uncapping station in said single continuously rotating phase of the machine, the capsule bodies being filled, re-capped and ejected at following, successive stations in said single, continuously rotating phase;

said filling station being disposed at a lesser radius than said feeding, uncapping and re-capping stations in said single continuously rotating phase of the machine, said stations including means for moving each capsule body radially inwardly to pass through said filling station, after it has been uncapped, and thereafter radially outwardly to pass through said re-capping station; and said filling station comprising fill forming means including at least one die mounted between upper and lower punches for forming each slug of fill and for delivering the formed slug of fill into a capsule body through the lower end of the die by the upper punch;

said fill forming means further including a single rotatable turret which is continuously rotated in use of the machine, the turret comprising a die table having a ring of dies lying on a common pitch circle centered on the axis of rotation of the turret with their axes parallel with the axis of rotation of the turret, and for each die an upper punch movable into and out of the upper end of the die, and a lower punch movable into and out of the lower end of said die, the die table also having a ring of capsule cap retaining cups, one for each die, the ring of capsule cap retaining cups lying on a common pitch circle concentric with, and of a diameter larger than, that of the dies, and for each of said capsule cap retaining cups one of said capsule delivery tubes is provided to deliver a capsule, cap uppermost, into the cup at said uncapping station, the capsule cap retaining cups each having a stepped bore the upper part of which accepts and axially rotationally locates a capsule cap but the lower part of which is of reduced diameter to accept only, and allow to pass, the body of a capsule, and for each capsule cap retaining cup and associated die a transfer slide is provided, working radially in a guide in the die table, between an inner and an outer position, the transfer slide carrying a capsule body transfer cup for receiving and transferring between the capsule cap retaining cup and the die and between the die and the capsule cap retaining cup for filling and re-capping respectively, each capsule body passing though the capsule cap retaining cup, the capsule body transfer cup having a stepped through-bore the upper part of which is sized to accept and axially and rotationally locate a capsule body in the cup with its upper edge in or below the upper surface of the slide.

16. A machine as claimed in claim 15, wherein the step defining the upper part of the stepped bore of each capsule cap retaining cup is at a depth below the surface of the die table not less than the height of the capsule caps.

17. A machine as claimed in claim 15 wherein the depth of the lower part of the stepped bore of each capsule cap retaining cap is sufficient wholly to contain that part of a capsule body which projects from the capsule cap in the assembled condition of the body and the cap.

18. A machine as claimed in claim 15, wherein each capsule body transfer cup and slide presents an upper surface portion which is upwardly inclined, from the inner edge of the upper surface of the wall of the cup in the radial outward direction of the slide to the uppr surface of the slide, to engage and lift a capsule body which penetrates below the upper surface of its slide but fails to separate from its cup.

19. A machine as claimed in claim 15, wherein the transfer slides are spring loaded outwardly and each carries a cam follower means engaging a radial cam encircling the turret, the radial cam acting to reciprocate the transfer slides inwardly, whereby each capsule body transfer cup is alternatively brought into line with its associated die and its associated capsule cap retaining cup as the turret rotates.

20. A machine as claimed in claim 19, wherein the radial cam is in the form of a ring and the outer end of each transfer slide is provided with a dog which normally clears the radial outer face thereof but is engaged thereby to return the transfer slide to its outer position should it stick in its guide for any reason.

21. A machine as claimed in claim 15 wherein the capsule delivery tubes are movable between alternate positions in and out of engagement with the upper ends of the capsule cap retaining cups during the single rotary phase of the machine so as to be in engagement with their cups at said uncapping station and said filling station and out of engagement with their cups at the re-capping station and the capusle ejection station, the filled capsules being ejected by the machine directly from the upper ends of the capsule cap retaining cups.

22. A machine as claimed in claim 21 further comprising first cam means for reciprocating the upper punches as the turret rotates, to advance each upper punch from a withdrawn position relative to its die, into its die to a first position therein, thereby to form a soft slug of fill material in the die, thereafter to advance the punch to a second position in its die to deliver the slug of fill material from the die, and thereafter to return the punch to said withdrawn position and each capsule delivery tube is coupled to reciprocate lengthwise between its alternate positions with the upper punch associated with its associated die, the tube being advanced into engagement with its capsule cap retaining cup when the punch is advanced from its withdrawn position into the die to form a soft slug of fill material in the die and being withdrawn out of engagement with its capsule cap retaining cup when the punch is returned to its withdrawn position.

23. A machine as claimed in claim 22 wherein said first cam means comprises cam follower means carried by upper punch holders, one for each upper punch, the cam follower means co-operating with a stationary upper cam assembly having a track centred on the axis of rotation of said turret to advance and withdraw the upper punches as aforesaid, each upper punch holder carries a crosshead which engages the associated capsule delivery tube to move the tube into engagement with its capsule cap retaining cup via a spring which takes up excess movement of the upper punch holder to advance its punch.

24. A machine as claimed in claim 23, wherein the spring is an open coiled spring co-axially disposed about the delivery tube.

25. A machine as claimed in claim 15 wherein the turret comprises an annular ring having a series of air holes, one for each capsule body transfer cup, which holes communicate with the lower ends of the capsule body transfer cups when the transfer slides are in their outer position, and a stationary member is proivded adjacent said ring, presenting at the uncapping station a segmental vacuum port which is traversed by said air holes to evacuate each capsule body transfer cup as it passes through the uncapping station, its transfer slide then being in its outer position.

26. A machine as claimed in claim 25, wherein a stationary member is provided adjacent said ring presenting, at the re-capping station, a segmental compressed air port which is traversed by said air holes to pressurise each capsule body transfer cup as it passes through the re-capping station, its transfer slide then being in its outer position.

27. A machine as claimed in claim 25 wherein a stationary member is provided adjacent said ring presenting, at the capsule ejection station, a segmental compressed air port which is traversed by said air holes to pressurise each capsule body transfer cup as it passes through the capsule ejection station, its transfer slide then being in its outer position.

28. A machine as claimed in claim 25, wherein said ring comprises a circular wall surrounding said lower punches, each punch operates in a separate pocket in the die table, said pocket opening upwardly to the die associated with the punch when the transfer slide associated with the die is in its outer position, and outwardly through an opening in said circular wall, and a stationary member is provided adjacent the outside of said circular wall presenting a vacuum port traversed by said openings for extracting fill entering said pockets.

29. A machine as claimed in claim 26 wherein said stationary member is annular and further presents, at the capsule ejection station, a segmental compressed air port which is traversed by said air holes to pressurise each capsule body transfer cup as it passes through the capsule ejection station, its transfer slide then being in its outer position, said ring comprises a circular wall surrounding said lower punches, each punch operates in a separate pocket in the die table, said pocket opening upwardly to the die associated with the punch when the transfer die associated with the slide is in its outer position, and outwardly through an opening in said circular wall, and said stationary member still further presents a vacuum port traversed by said openings for extracting fill entering said pockets.

30. A machine as claimed in claim 26 further comprising a stationary capsule closing plate overlying said ring of dies at the re-capping station of the machine, the clearance between the plate and the surface of the die table being at a minimum over an initial arc of rotation of the turret through the recapping station, the plate being stepped to increase this clearance suddenly over a terminal arc of rotation of the turret the re-capping station.

31. A machine as claimed in claim 30, further comprising a capsule delivery chute at the terminal and of said capsule closing plate for directing filled and closed capsules away from the die table.

32. A machine as claimed in claim 31, further comprising a compressed air jet for assisting the filled and closed capsules through said chute.

33. A hard-gelatin capsule filling machine for filling two-piece capsules comprising:

an uncapping station for uncapping a capsule, means for compressing a quantity of fill into a soft slug, a filling station for inserting the slug into the bottom part or body of the capsule, a re-capping station for re-capping the body part, and an ejection station for thereafter ejecting the filled capsule in a single, continuously rotating phase of the machine;

an empty capsule hopper for a random bulk supply of the capsules;

means for feeding a series of capsules successively from the random bulk supply of the capsules contained in the hopper to said uncapping station in said single, continuously rotating phase of the machine, the capsule bodies being filled, recapped and ejected at following successive stations in the single, continuously rotating phase;

said capsule feeding means including a continuously rotating circular array of capsule delivery tubes, disposed in said single rotating phase of the machine and arranged to feed the capules downwardly, singly in succession, to the uncapping station, cap uppermost, each through a succeeding one of the capsule delivery tubes, and means in the machine and arranged to feed capsules in succession to the delivery tubes at a station in advance of said uncapping station in said single continuously rotating phase of the machine;

said capsule feeding means further including a single rotatable turret which is continuously rotated through said single rotating phase of the machine in use of the machine, the turret comprising said capsule delivery tubes and a table having a ring of capsules cap receiving cups lying on a common pitch circle centered on the axes of rotation of the turret, and for each of said capsule cap receiving cups, one of said capsule delivery tubes is provided to deliver a capsule, cap uppermost, into the cup at said uncapping station; and said empty capsule hopper comprising a stationary timing member and a capsule orientation assembly which is fixed to, and rotates with, the turret, the assembly presenting a ring of identical openings disposed one over each capsule delivery tube and adapted, in co-operation with the timing member, so to position an empty capsule fed into the opening from a random bulk supply of similarly sized empty capsules in the hopper by feed means associated with the hopper, with its long axis normal to the long axis of the capsule delivery tube and extending in a predetermined direction in relation thereto, each opening having spaced portions, spaced apart in the lengthwise direction of the capsule, of a width dimension sufficient to pass the capsule body but not its cap, the intermediate portion of said opening having a greater width, and a length, sufficient to pass the capsule cap, the timing member acting to support the capsule in said opening and allowing it to fall through the intermediate portion thereof, at said feeding station, the capsule then pivoting on one pair of corners of said opening at the junction of its intermediate portion and one of its said spaced portions to align its long axis with the long axis of the capsule delivery tube with its cap uppermost.

34. A machine as claimed in claim 33, wherein the feed means for feeding capsules to said ring of identical openings comprises a plate which rotates with said turret, the plate forming the floor of the empty capsule hopper, and said identical openings are defined in a peripheral edge portion of said plate.

35. A machine as claimed in claim 34, wherein said plate carries a shallow conical member at its centre which assists in feeding capsules towards the peripheral edge portion of the plate.

36. A machine as claimed in claim 34 wherein said identical openings in said plate are each in the form of a separate elongated aperture having proportions in the floor surface of the hopper to clear the profile of the capsule and to position the capsule with its long axis tangential with respect to the axis of rotation of the turret, and said spaced portions and said intermediate portion of said opening are defined in the floor of the aperture below the level of the floor surface of the hopper.

37. A machine as claimed in claim 36, wherein the empty capsule hopper has a main, stationary, full circular outer wall, concentric with the axis of rotation of the turret, the lower edge of which just embraces said apertures, an inner part circular wall concentric with the main wall having its ends extended outwardly to meet the main wall, the radius of the curved part of the inner wall being less than the radius of the pitch circle of said apertures whereby said apertures pass to the outside of said curved inner wall part, the outer wall being cut away locally over the arc of the curved inner wall part, and the hopper further comprising a rotatable brush having its axis disposed parallel with the floor of the hopper and tangential with respect to said curved inner wall part, the brush being disposed over said apertures in the region where they pass to the outside of said inner wall so as to lightly brush the floor, and drive means for rotating the brush to sweep back any capsules not seated in an aperture passing under the brush, said apertures having a depth sufficient to contain a capsule at or below the level of the hopper floor.

38. A machine as claimed in claim 34, wherein the timing member has an edge portion underlying said openings and disposed between said openings and a ring of internally coned capsule receiving cups, one associated and carried around with each of the capsule delivery tubes, and said edge portion has a cut out at said feeding station which allows capsules to fall through said openings into said capsule cap receiving cups.

39. A machine as claimed in claim 33, wherein the feed means for feeding capsules to said ring of identical openings comprises a slotted capsule feed plate which rotates with said turret over a stationary floor of said empty capsule hopper, the slots in said feed plate extending outwardly with respect to the axis of rotation of the turret, each to feed one of said identical openings, each slot having a width to receive a single row of capsules disposed end to end in the slot, and the slots are inclined rearwardly with respect to the direction of rotation of the turret from their inner to their outer ends.

40. A machine as claimed in claim 39, wherein said slots are straight.

41. A machine as claimed in claim 39 wherein said slots have a depth equal to the diameter of the capsules.

42. A machine as claimed in claim 39, wherein the feed plate has a thickened central band which provides a roof over an intermediate lengthwise portion of all the slots so forming passageways through which capsules pass to the outside of nonrotating wall of the empty capsule hopper.

43. A machine as claimed in claim 42, wherein the upper surface of said thickened central band is inclined inwardly inside said non-rotating wall, the thickened central band having a close running clearance with the lower edge of the wall.

44. A machine as claimed in claim 39, wherein said ring of identical openings are formed, one at the outer end of each of said slots, as a continuation of the slot, the opening being open-ended at its inner end and being arranged to position a capsule with its long axis extending along the centre line of the slot, and said spaced portions and said intermediate portion of said opening are defined in the base of each slot outer end.

45. A machine as claimed in claim 44, wherein said stationary floor has an edge portion underlying said ring of identical openings, the edge portion constituting said timing member.

46. A machine as claimed in claim 45, wherein a stationary cover covers over the outer ends of said slots to prevent capsules lifting out of the slot outer ends.

47. A machine as claimed in claim 45 wherein said stationary floor is supported upon a support plate which rotates with said slotted capsule feed plate, the floor being formed by a thin flexible diaphragm sheet, and the support plate is supported by a ring of internally coned capsule receiving cups, one associated and carried round with each of the capsule delivery tubes, the support plate having a ring of apertures and the edge portion of said diaphragm sheet having a cut out at said feeding station which allows capsules to fall through said openings into the capsule receiving cups.

48. A machine as claimed in claim 39, wherein said slotted feed plate is annular, said slots extend from the inner peripheral edge of the plate, and the stationary floor of the hopper comprises a central conical portion presenting a smooth upwardly directed surface downwardly inclined from the centre towards the outside to encourage capsules to move outward towards said slots.

49. A machine as claimed in claim 39, further comprising non-rotating deflectors inside the hopper and extending, over the slotted feed plate, forwardly with respect to the direction of rotation thereof, the deflectors having flexible fingers which trail over the upper surface of the plate.

50. A machine as claimed in claim 39, wherein means comprising a stationary retraction blade is provided to push back by camming action all capsules following a leading capsule along each of said slots, to separate the leading capsule from its following capsules during the passage of the slot outer end through the feeding station, said blade running in a groove in said feed plate which groove traverses each of said slots.

51. A machine as claimed in claim 50 wherein the feed plate has a thickened central band which provides a roof over an intermediate lengthwise portion of all the slots so forming passageways through which capsules pass to the outside of a non-rotating wall of the empty capsule hopper and said retraction blade is secured to the outside of said non-rotating hopper wall.

52. A machine as claimed in claim 33, wherein said ring of identical openings pass under a stationary vacuum port immediately following their passage through the uncapping station, which port is connected with external extraction equipment, and said blade extends through the arc of said port.

53. A machine as claimed in claim 52, wherein said ring of identical openings pass under a second stationary vacuum port connected with said external extraction equipment, the second port having a hinged blade member at its radially inner edge which co-operates with said groove, the blade member having a sideways extension which normally rests on the upper surface of said capsule feed plate to retain a complete capsule in any one of said openings, an incomplete capsule allowing the next following capsule approaching the opening to lift said hinged blade thereby releasing the incomplete capsule for extraction through said second port, said second port having an arcuate extent such that each of said identical openings passes separately under the port.

54. A method of operating a hard-gelatin capsule filling machine for filling two piece capsules and of the kind in which the fill is compressed into a soft slug which is thereafter inserted into the bottom part or body of the capsule characterised in that the capsules are uncapped, filled, re-capped and thereafter ejected from the machine in a single, continuously rotating phase of the machine.

55. A method as claimed in claim 54 wherein a series of the capsules are fed successively from a bulk supply of the capsules, uncapped, filled, re-capped and thereafter ejected at successive stations in the single rotating phase.

56. A method as claimed in claim 55 wherein the empty capsules are fed downwardly, single in succession, to the uncapping station in the single rotating phase, cap uppermost, each through one of a succession of capsule delivery tubes disposed in circular array in said single rotating phase of the machine.

57. A method as claimed in claim 56 wherein the empty capsules are fed from a random bulk supply of the capsules in a hopper disposed above said circular array of capsule delivery tubes, capsules being fed in succession from the hopper to the delivery tubes at a feeding station in advance of the uncapping station.

58. A method of filling hard gelatin two piece capsules comprising continuously feeding empty capsules, from a random bulk supply of the capsules, downwardly, singly in succession and with their caps uppermost, into a transverse path of continuous circular movement, continuing the downward movement of each capsule body during movement of the capsule along said transverse circular path of movement through an uncapping station defined therealong, thereby to separate the capsule body from its cap, continuing the movement of the cap along the transverse circular path of movement while moving the body of the capsule radially inwardly, relative to its cap, into a second path of continuous circular movement concentric with said transverse circular path of movement, forming a soft slug of fill and inserting the slug into the body of the capsule during movement of the capsule body through a filling station defined along said second circular path, moving the filled body of the capsule radially outwardly relative to its cap into said transverse circular path of movement and then moving the body upwardly to re-cap the capsule during movement of the body and cap through a re-capping station defined along said transverse circular path, and thereafter moving the filled capsule upwardly to eject the capsule out of said transverse circular path of movement during passage of the filled capsule through an ejection station defined along said transverse circular path of movement.

59. A hard-gellatin capsule filling machine for filling two-piece capsules comprising:

an uncapping station for uncapping a capsule, means for compressing a quantity of fill into a soft slug, a filling station for inserting the slug into the bottom part or body of the capsule, a re-capping station for re-capping the body part, and an ejection station for thereafter ejecting the filled capsule in a single, continuously rotating phase of the machine;

an empty capsule hopper for a random bulk supply of the capsules; and means for feeding a series of capsules successively from the random bulk supply of the capsules contained in the hopper to said uncapping station in said single, continuously rotating phase of the machine, the capsule bodies being filled, re-capped and ejected at following successive stations in the single, continuously rotating phase;

said capsule feeding means including a continuously rotating circular array of capsule delivery tubes, disposed in said single rotating phase of the machine and arranged to feed the capsules downwardly, singly in succession to the uncapping station, cap uppermost, each through a succeeding one of the capsule delivery tubes, and continuously rotating means, also disposed in said single rotating phase of the machine and arranged to feed capsules in succession to the delivery tubes at a station in advance of said uncapping station in said single continuously rotating phase of the machine.

60. A machine as claimed in claim 59 wherein the filling station is disposed at a lesser radius than the feeding, uncapping and re-capping stations in said single continuously rotating phase of the machine, and each capsule body is moved radially inwardly to pass through the filling station, after it has been uncapped, and thereafter radially outwardly to pass through the re-capping station.

61. A hard-gelatin capsule filling machine for filling two piece capsules comprising:

an uncapping station for uncapping a capsule, means for compressing a quantity of filling into a soft slug, a filling station for inserting the slug into the bottom part or body of the capsule, a re-capping station for re-capping the body part, and an ejection station for thereafter ejecting the filled capsule in a single, continuously rotating phase of the machine;

said filling station comprising fill forming means including at least one die mounted between upper and lower punches for forming each slug of fill and for delivering the formed slug of fill into a capsule body through the lower end of the die by the upper punch;

said fill forming means further including a single rotatable turret, which is continuously rotated in use of the machine, the turret comprising a die table having a ring of dies lying on a common pitch circle centered on the axis of rotation of the turret with their axes parallel with the axis of rotation of the turret, and for each die an upper punch movable into and outer of the upper end of said die, and a lower punch movable into and out of the lower end of said die; and said machine further comprising a hopper for fill material, a rotary feeder for feeding fill from the hopper, and a stationary feed frame positioned over the die table so as to be traversed by said ring of dies, said feed frame being arranged to receive fill material from said rotary feeder and carrying a scraper blade to deflect surplus fill material leaving one end of the feed frame inwardly so that it is carried around on the die table inside the ring of dies, the surplus fill material re-entering the feed frame at its opposite end.

62. A machine as claimed in claim 61, further comprising a re-circulating band having its ends connected respectively to opposite ends of the feed frame for containing the surplus fill material on the die table inside the ring of dies.

63. A method of operating a hard gelatin capsule filling machine for filling two-piece capsules wherein the fill is compressed to a soft slug which is thereafter inserted into the bottom part or body of the capsule, comprising:

feeding a series of the capsules successively from a random bulk supply of the empty capsules contained in a hopper to an uncapping station, uncapping said empty capsules, filling said uncapped capsules, recapping said capsules and thereafter ejecting said capsules at successive stations in a single, continuously rotating phase of the machine;

said feeding step including:

feeding said empty capsules downwardly, singly in succession, to the uncapping station in the single rotating phase of the machine, with the cap uppermost, each through one of a succession of capsule delivery tubes disposed in a continuously rotating circular array in said single rotating phase of the machine;

feeding said capsules in succession to the delivery tubes at a feeding station in advance of the uncapping station by rotatable feeding means located in said single rotating phase of the machine; and continuously rotating said rotatable feeding means.

64. A method of operating a hard gelating capsule filling machine for filling two-piece capsules wherein the fill is compressed to a soft slug which is thereafter inserted into the bottom part or body of the capsule, comprising:

feeding a series of the capsules successively from a random bulk supply of the empty capsules contained in a hopper to an uncapping station, uncapping said empty capsules, filling said uncapped capsules, recapping said capsules and thereafter ejecting said capsules at successive stations in a single, continuously rotating phase of the machine;

the filling station being disposed at a lesser radius than the feeding, uncapping and re-capping stations in said single rotating phase of the machine; and moving each capsule body radially inwardly to pass through the filling station, after it has been uncapped, and thereafter radially outwardly to pass through the recapping station.

* * * * *

UNITED STATES PATENT OFFICE
CERTIFICATE OF CORRECTION

Patent No. 3,978,640 Dated September 7, 1976

Inventor(s) Jack CROSSLEY et al

It is certified that error appears in the above-identified patent and that said Letters Patent are hereby corrected as shown below:

Column 16, line 43, after "uncapping" (second occurrence) insert --a--;

Column 19, line 54, after "slide to the" change "uppr" to --upper--;

line 57, after "from its" change "cup" to --cap--;

Column 21, line 37, after "turret" insert --through--.

Signed and Sealed this

First Day of March 1977

[SEAL]

*Attest:*

RUTH C. MASON
*Attesting Officer*

C. MARSHALL DANN
*Commissioner of Patents and Trademarks*